US009417568B2

(12) United States Patent
Katagiri et al.

(10) Patent No.: US 9,417,568 B2
(45) Date of Patent: Aug. 16, 2016

(54) IMAGE FORMING APPARATUS USING STRETCH MEMBER AND CONTACT MEMBER TO MAINTAIN POTENTIAL WITH A CURRENT FLOWING TO INTERMEDIATE TRANSFER BELT

(71) Applicant: CANON KABUSHIKI KAISHA, Tokyo (JP)

(72) Inventors: Shinji Katagiri, Yokohama (JP); Yuji Kawaguchi, Tokyo (JP); Masaru Ohno, Ebina (JP); Tsuguhiro Yoshida, Yokohama (JP); Takeo Kawanami, Yokohama (JP); Taro Minobe, Tokyo (JP); Masaru Shimura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/798,018

(22) Filed: Jul. 13, 2015

(65) Prior Publication Data

US 2015/0316874 A1 Nov. 5, 2015

Related U.S. Application Data

(63) Continuation of application No. 13/828,748, filed on Mar. 14, 2013, now Pat. No. 9,158,238.

(30) Foreign Application Priority Data

| | | |
|---|---|---|
| Apr. 3, 2012 | (JP) | 2012-085027 |
| Apr. 3, 2012 | (JP) | 2012-085028 |
| Apr. 4, 2012 | (JP) | 2012-085548 |
| Feb. 8, 2013 | (JP) | 2013-023425 |

(51) Int. Cl.
*G03G 15/01* (2006.01)
*G03G 15/16* (2006.01)

(52) U.S. Cl.
CPC ..... *G03G 15/1665* (2013.01); *G03G 15/1605* (2013.01); *G03G 15/1615* (2013.01); *G03G 15/1675* (2013.01)

(58) Field of Classification Search
CPC ..... G03G 15/1605; G03G 15/1615; G03G 15/1675
USPC ..... 399/66, 298, 299, 302, 313, 314
See application file for complete search history.

(56) References Cited

U.S. PATENT DOCUMENTS 6,134,415 A * 10/2000 Iwakura et al. .... G03G 15/0131 399/299
6,421,521 B2 * 7/2002 Tanaka ..... G03G 15/0131 399/299

(Continued)

FOREIGN PATENT DOCUMENTS

| | | | |
|---|---|---|---|
| JP | H03-186876 | A | 8/1991 |
| JP | 2003248383 | A | 9/2003 |
| JP | 2003-280331 | A | 10/2003 |
| JP | 2006221048 | A | 8/2006 |

(Continued)

*Primary Examiner* — William J Royer
(74) *Attorney, Agent, or Firm* — Canon USA, Inc., IP Division

(57) ABSTRACT

A voltage maintenance element is connected to a contact member that contacts a primary transfer surface area of an intermediate transfer belt to which toner images are transferred from a plurality of image carriers between stretch members, in such a way as to prevent the electric potential of the intermediate transfer belt from varying between respective image forming stations.

32 Claims, 28 Drawing Sheets

(56) References Cited

U.S. PATENT DOCUMENTS 7,289,757 B2 * 10/2007 Sharma et al. ..... G03G 15/80 399/299
9,158,238 B2 * 10/2015 Katagiri et al. .... G03G 15/1675

FOREIGN PATENT DOCUMENTS

JP 2006259639 A 9/2006
KR 10-2003-0021516 A 3/2003
KR 10-2006-0044293 A 5/2006

* cited by examiner

IMAGE FORMING APPARATUS USING STRETCH MEMBER AND CONTACT MEMBER TO MAINTAIN POTENTIAL WITH A CURRENT FLOWING TO INTERMEDIATE TRANSFER BELT

CROSS-REFERENCE TO RELATED APPLICATIONS

This application is a Continuation of U.S. patent application Ser. No. 13/828,748 filed Mar. 14, 2013 (now U.S. Pat. No. 9,158,238), which claims priority from Japanese Patent Application No. 2012-085027 filed Apr. 3, 2012, Japanese Patent Application No. 2012-085028 filed Apr. 3, 2012, Japanese Patent Application No. 2012-085548 filed Apr. 4, 2012, and Japanese Patent Application No. 2013-023425 filed Feb. 8, 2013. Each of U.S. patent application Ser. No. 13/828,748, Japanese Patent Application No. 2012-085027, Japanese Patent Application No. 2012-085028, Japanese Patent Application No. 2012-085548, and Japanese Patent Application No. 2013-023425 is hereby incorporated by reference herein in its entirety.

BACKGROUND OF THE INVENTION

1. Field of the Invention

The present invention relates to an electrophotographic image forming apparatus, such as a copying machine or a printer.

2. Description of the Related Art

An image forming apparatus that includes an intermediate transfer member is conventionally known as an electrophotographic image forming apparatus. The conventional image forming apparatus includes a first voltage power source (i.e., a power source circuit) that can apply an electric voltage to a primary transfer member disposed in a confronting relationship with a photosensitive drum via the intermediate transfer member. The intermediate transfer member includes a primary transfer portion at which the intermediate transfer member can contact the photosensitive drum. An electric potential of the primary transfer portion is maintained at a predetermined level (which is referred to as a "primary transfer potential"). Then, the conventional image forming apparatus performs a primary transfer process for primarily transferring a toner image formed on a surface of the photosensitive drum (which serves as an image carrier) to the intermediate transfer member in a state where a predetermined potential difference is formed between the photosensitive drum and the intermediate transfer member.

The conventional image forming apparatus repetitively performs the above-mentioned primary transfer process for each of a plurality of colors to form a plurality of color toner images on the surface of the intermediate transfer member. Then, the conventional image forming apparatus performs a secondary transfer process for secondarily transferring the plurality of color toner images formed on the surface of the intermediate transfer member to a surface of a recording material (e.g., a paper) in a state where a second voltage power source applies a predetermined voltage to a secondary transfer member. The conventional image forming apparatus includes a fixing unit that subsequently fixes the toner images transferred on the recording material.

As discussed in Japanese Patent Application Laid-Open No. 2001-175092, an endless belt is conventionally used as an intermediate transfer member (which is hereinafter referred to as an "intermediate transfer belt"). A transfer power source (i.e., a power source circuit) dedicated to the primary transfer is connected to a stretch member that stretches an inner circumferential surface of the intermediate transfer belt or to the primary transfer member. The power source circuit supplies current that flows in the circumferential direction of the intermediate transfer belt to perform a primary transfer operation.

The intermediate transfer belt rotates and moves in a direction that corresponds to the above-mentioned circumferential direction of the intermediate transfer belt. According to the configuration discussed in Japanese Patent Application Laid-Open No. 2001-175092, the primary transfer potential is formed at each primary transfer portion in a state where a partial voltage is generated when the current supplied from the current supply member (i.e., the stretch member or the primary transfer member), to which the transfer power source is connected, flows in the circumferential direction of the intermediate transfer belt.

However, according to the configuration discussed in Japanese Patent Application Laid-Open No. 2001-175092 in which the primary transfer operation is performed while current flows in the circumferential direction of the intermediate transfer belt, the primary transfer potential at the primary transfer portion of each image forming station is greatly influenced by the resistance value of the intermediate transfer belt and the distance from the current supply member.

More specifically, the primary transfer potential becomes lower if an image forming station is positioned far from the current supply member. In other words, there is the possibility of causing a large difference in the primary transfer potential between an image forming station positioned near the current supply member and the image forming station positioned far from the current supply member. If the primary transfer potential cannot be appropriately maintained at each image forming station, transferring a required amount of toners to the intermediate transfer belt becomes difficult. The images fixed on a recording material may have a transfer defect (e.g., defect in density).

SUMMARY OF THE INVENTION

The present invention is directed to an image forming apparatus that can prevent the primary transfer potential from varying at the primary transfer portion and can secure satisfactory primary transfer characteristics when current flows from the current supply member to the intermediate transfer belt.

According to an aspect of the present invention, an image forming apparatus includes a plurality of image carriers each carrying a toner image, a movable and electrically conductive intermediate transfer belt to which toner images are primarily transferred from the plurality of image carriers, a plurality of stretch members that stretch the intermediate transfer belt, a current supply member that contacts the intermediate transfer belt and supplies current to the intermediate transfer belt, a contact member disposed between the stretch members in such away as to contact a primary transfer surface side of the intermediate transfer belt to which the toner images are transferred from the plurality of image carriers, and a voltage maintenance element that is connected to the contact member and at least one of the stretch members. The stretch member to which the voltage maintenance element is connected and the contact member maintain a predetermined potential or more with the current flowing from the current supply member to the intermediate transfer belt.

According to another aspect of the present invention, an image forming apparatus includes a plurality of image carriers each carrying a toner image, a movable and electrically conductive intermediate transfer belt to which toner images are primarily transferred from the plurality of image carriers, a current supply member that contacts the intermediate transfer belt and supplies current to the intermediate transfer belt, a contact member that contacts a primary transfer surface side of the intermediate transfer belt to which the toner images are transferred from the plurality of image carriers, a counter member opposed to the current supply member via the intermediate transfer belt, and a voltage maintenance element connected to the contact member. The contact member connected to the voltage maintenance element maintains a predetermined potential or more with the current flowing from the current supply member to the counter member.

According to yet another aspect of the present invention, an image forming apparatus includes a plurality of image carriers each carrying a toner image, a movable and electrically conductive intermediate transfer belt to which toner images are primarily transferred from the plurality of image carriers, a plurality of stretch members that stretch the intermediate transfer belt, a current supply member that contacts the intermediate transfer belt and supplies current to the intermediate transfer belt, a plurality of contact members disposed between the stretch members in such a way as to contact a primary transfer surface side of the intermediate transfer belt to which the toner images are transferred from the plurality of image carriers, and a voltage maintenance element that is connected to the plurality of contact members. The plurality of contact members connected to the voltage maintenance element maintains a predetermined potential or more with the current flowing from the current supply member to the intermediate transfer belt.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Dimensions, materials, shapes, and relative positioning of constituent components described in the following exemplary embodiments are appropriately changeable depending on an actual configuration of an apparatus to which the present invention is applied, and various conditions. Therefore, unless it is specifically mentioned, the present invention is not narrowly restricted to these embodiments and various modifications are allowed in a range within the scope thereof.

Figure 1:
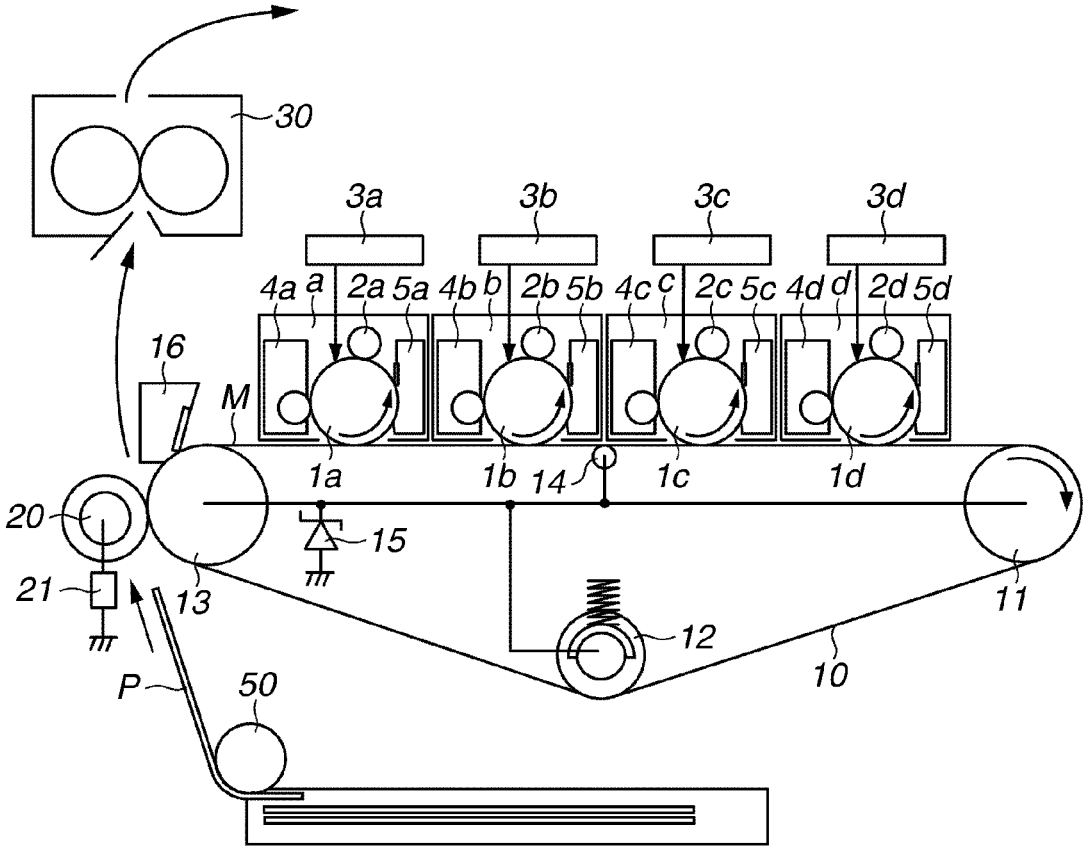
FIG. 1 schematically illustrates an image forming apparatus according to a first exemplary embodiment.

A mechanical configuration and operations of an image forming apparatus according to a first exemplary embodiment are described below with reference to FIG. 1. FIG. 1 schematically illustrates an example of a color image forming apparatus. The image forming apparatus according to the present exemplary embodiment is a tandem type printer that includes four image forming stations "a" to "d" that are sequentially disposed. The first image forming station "a" can form a yellow (Y) image. The second image forming station "b" can form a magenta (M) image. The third image forming station "c" can form a cyan (C) image. The fourth image forming station "d" can form a black (Bk) image. The configurations of respective image forming stations "a" to "d" are similar to each other, except for the color of toners to be processed in each image forming station "a" to "d". As a representative station, the first image forming station "a" is described in detail below.

The first image forming station "a" includes an electrophotographic photosensitive member having a drum-shaped body (which is hereinafter referred to as a "photosensitive drum") 1*a*, a charging roller 2*a*, a development unit 4*a*, and a cleaning unit 5*a*. The photosensitive drum 1*a* is an image carrier carrying a toner image that can rotate in a direction indicated by an arrow at a predetermined peripheral speed (i.e., a process speed).

Further, the development unit 4*a* is an apparatus that stores yellow toner particles to develop a yellow toner image on the photosensitive drum 1*a*. The cleaning unit 5*a* is a member that can collect toner particles remaining on the photosensitive drum 1*a*. In the present exemplary embodiment, the cleaning unit 5*a* includes a cleaning blade serving as a cleaning member that can contact the photosensitive drum 1*a* and a toner collection box that stores the toner particles collected by the cleaning blade.

When a controller 100 (i.e., a control unit) (FIG. 2) receives an image signal, the first image forming station "a" starts an image forming operation by rotating the photosensitive drum 1*a* in a predetermined direction. The photosensitive drum 1*a* is uniformly charged by the charging roller 2*a*, in its rotation process, to have a predetermined potential of predetermined polarity (negative polarity in the present exemplary embodiment) and exposed by an exposure unit 3*a* based on the image signal. Through the above-mentioned operations, an electrostatic latent image that corresponds to a yellow color image (i.e., an intended color image) can be formed.

Next, the electrostatic latent image is developed by the development unit (i.e., yellow development unit) 4*a* and visualized as a yellow toner image. In the present exemplary embodiment, the normal charging polarity of toner particles accommodated in the development unit is negative polarity. The electrostatic latent image is reversely developed with toner particles having been charged to have a polarity identical to the charging polarity of the photosensitive drum charged by the charging roller. However, the present invention is applicable to an electrophotographic apparatus that develops an electrostatic latent image with toner particles having been charged to have a polarity opposed to the charging polarity of the photosensitive drum.

An intermediate transfer belt 10 is stretched by a plurality of stretch members (stretch rollers) 11, 12, and 13. In a counter region where the intermediate transfer belt 10 contacts the photosensitive drum 1*a*, the intermediate transfer belt 10 moves in a predetermined direction at a traveling speed that is substantially equal to the peripheral speed of the rotating photosensitive drum 1*a*. The yellow toner image formed on the photosensitive drum 1*a* is primarily transferred to the intermediate transfer belt 10 when the image passes through the abutting portion (which is hereinafter referred to as a "primary transfer portion") between the photosensitive drum 1*a* and the intermediate transfer belt 10.

In the present exemplary embodiment, current flows from a current supply member to the intermediate transfer belt 10 in the primary transfer operation, in a state where the current supply member contacts the intermediate transfer belt 10. The applied current realizes a formation of a primary transfer potential at the primary transfer portion of the intermediate transfer belt 10 that corresponds to each image forming station. A primary transfer potential forming method according to the present exemplary embodiment is described below.

The cleaning unit 5*a* cleans and removes the toner particles remaining on the surface of the photosensitive drum 1*a* without being primarily transferred. The cleaned photosensitive drum 1*a* can be used for the next charging and image forming processes.

Similarly, the second image forming station "b" forms a magenta (i.e., the second color) toner image. The third image forming station "c" forms a cyan (i.e., the third color) toner image. The fourth image forming station "d" forms a black (i.e., the fourth color) toner image. Respective toner images are successively transferred, in an overlapped fashion, onto the intermediate transfer belt 10 at primary transfer portions of respective image forming stations "a" to "d". A full-color image that corresponds to an intended color image can be obtained through the above-mentioned processes.

Subsequently, the four-type color toner images on the intermediate transfer belt 10 are batch transferred (i.e., secondarily transferred) onto a surface of a recording material P supplied by a paper feeding unit 50 when the images pass through a secondary transfer portion formed by the intermediate transfer belt 10 and a secondary transfer roller 20.

The secondary transfer roller 20 is operable as a secondary transfer member. The secondary transfer roller 20 includes a nickel-plated steel bar having an 8 mm outer diameter, which is covered by an expanded sponge member to have an 18 mm outer diameter. The expanded sponge member has a $10^8$ Ω·cm volume resistivity and a 5 mm thickness. Main components of the expanded sponge member are NBR and epichlorohydrin rubber. The secondary transfer roller 20 contacts an outer circumferential surface of the intermediate transfer belt 10 under application of a 50 N pressing force, to form the secondary transfer portion.

The secondary transfer roller 20 rotates when the secondary transfer roller 20 is driven by the intermediate transfer belt 10. When the toner particles on the intermediate transfer belt 10 are secondarily transferred to the recording material P (e.g., a paper), a transfer power source 21 (i.e., a power source circuit) applies a 2500 [V] secondary transfer voltage to the secondary transfer roller 20.

The transfer power source 21 includes a voltage transformer that can supply the secondary transfer voltage to the secondary transfer roller 20. The controller 100 controls an output voltage of the transformer in such a manner that the secondary transfer voltage supplied from the transfer power source 21 can be maintained at a substantially constant level. The output voltage of the transfer power source 21 is in a range from 100 [V] to 4000 [V].

Subsequently, the recording material P on which the four-type color toner images are carried is conveyed into a fixing device 30, in which the four-type color toner images are melted into a mixed color toner image through heating and pressing processes and then fixed on the recording material P. Toner particles remaining on the intermediate transfer belt 10 without being secondarily transferred are cleaned and removed by a cleaning unit 16 that includes a cleaning blade. Formation of a full-color print image ends upon completion of the above-mentioned operations.

Figure 2:
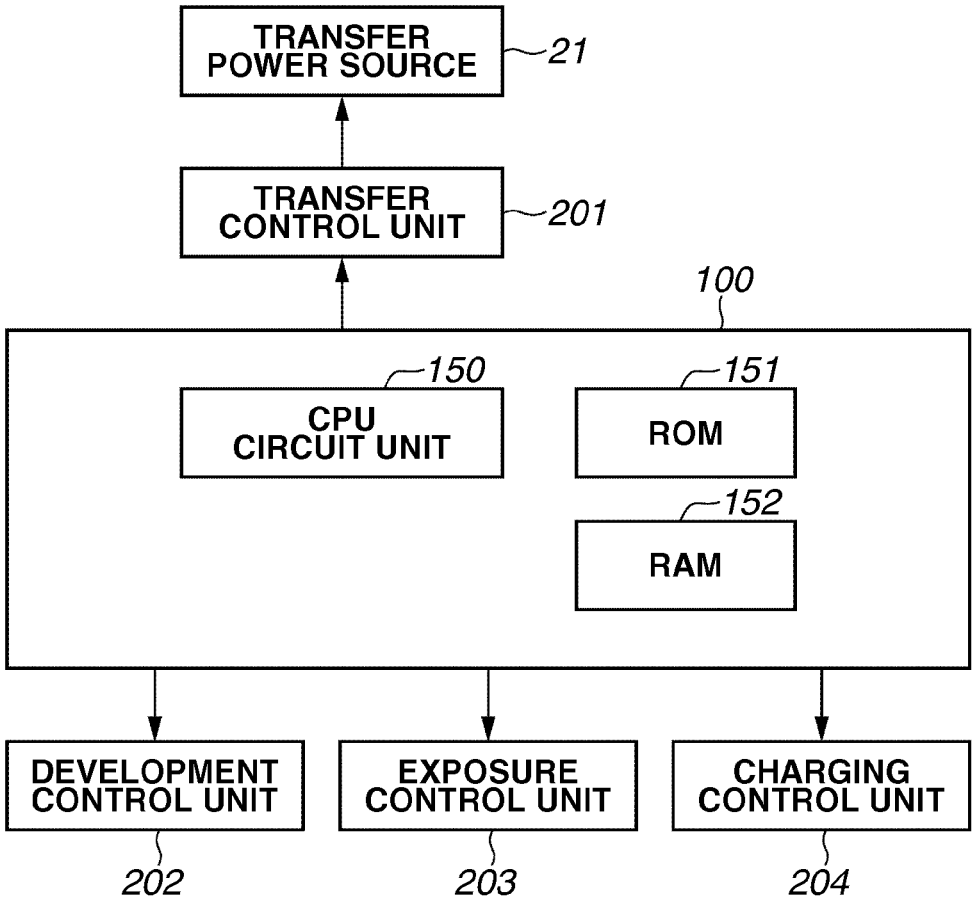
FIG. 2 is a block diagram illustrating various control units of the image forming apparatus according to the first exemplary embodiment.

A detailed configuration of the controller 100, which performs various controls for the image forming apparatus, is described below with reference to FIG. 2. As illustrated in FIG. 2, the controller 100 includes a central processing unit (CPU) circuit unit 150. The controller 100 includes a read only memory (ROM) 151 and a random access memory (RAM) 152, which are two built-in memories. The CPU circuit unit 150 can control a transfer control unit 201, a development control unit 202, an exposure control unit 203, and a charging control unit 204 according to a control program stored in the ROM 151. The CPU circuit unit 150 can perform processing with reference to an environment data table and a paper thickness correspondence table loaded from the ROM 151. The RAM 152 can temporarily store control data and can serve as a work area when the CPU circuit unit 150 performs various control processing.

The transfer control unit 201 can control the transfer power source 21 in such a way as to adjust the voltage to be output from the transfer power source 21 based on a current value detected by a current detection circuit (not illustrated). If the controller 100 receives image information and a print command from a host computer (not illustrated), the CPU circuit unit 150 controls respective control units (i.e., the transfer control unit 201, the development control unit 202, the exposure control unit 203, and the charging control unit 204), which perform the image forming operation to realize a print operation.

The intermediate transfer belt 10, the stretch members 11, 12, and 13, and a contact member 14 have the following configurations.

The intermediate transfer belt 10 is operable as an intermediate transfer member, which extends along a straight line in such a way as to face respective image forming stations "a" to "d" that are sequentially disposed. The intermediate transfer belt 10 is an endless belt, which is made of an electrically conductive resin material including conducting agent additives. The intermediate transfer belt 10 is entrained around three stretch members, i.e., a driving roller 11, a tension roller 12, and a secondary transfer counter roller (i.e., a secondary transfer counter member) 13. The tension roller 12 applies a 60 N tensile force to the intermediate transfer belt 10.

The intermediate transfer belt 10 can rotate in a predetermined direction in accordance with rotation of the driving roller 11 that is driven by a driving source (not illustrated), in such a manner that the intermediate transfer belt 10 moves at the traveling speed that is substantially identical to the peripheral speed of respective photosensitive drums 1*a*, 1*b*, 1*c*, and 1*d*, in counter regions where the intermediate transfer belt 10 contacts respective photosensitive drums 1*a*, 1*b*, 1*c*, and 1*d*.

A straightly extending surface of the intermediate transfer belt 10 between two stretch members (i.e., the secondary transfer counter roller 13 and the driving roller 11), to which toner images are primarily transferred from respective photosensitive drums 1*a*, 1*b*, 1*c*, and 1*d*, is referred to as a primary transfer surface M.

Figure 3A:
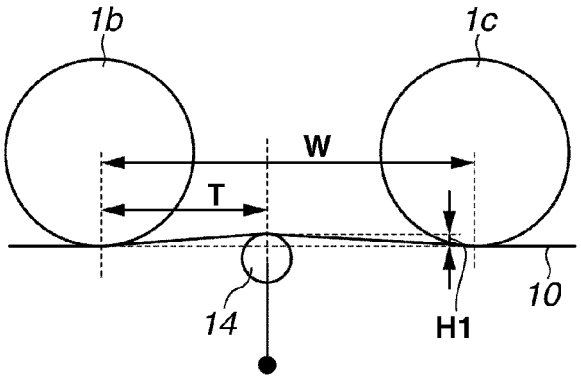
FIGS. 3A and 3B illustrate a configuration of a primary transfer portion according to the first exemplary embodiment.

The metallic roller 14 is operable as the contact member that contacts the intermediate transfer belt 10. As illustrated in FIG. 3A, the metallic roller 14 is disposed at an intermediate position between the photosensitive drum 1*b* and the photosensitive drum 1*c* in a moving direction of the intermediate transfer belt 10. In the present exemplary embodiment, the contact member contacts the primary transfer surface side of the intermediate transfer belt 10 between the secondary transfer counter roller 13 and the driving roller 11 where toner images are transferred from a plurality of photosensitive drums.

The metallic roller 14 secures a sufficient length of the intermediate transfer belt 10 to be wound around respective photosensitive drums 1*b* and 1*c* at the intermediate position between the second image forming station "b" and the third image forming station "c." To this end, both ends of the metallic roller 14 are held at a higher position, in the longitudinal direction thereof, relative to a horizontal surface extending between respective photosensitive drums 1*b* and 1*c* and the intermediate transfer belt 10.

The metallic roller 14 is made of a nickel-plated SUS bar that has a 6 mm outer diameter and extends straight. The metallic roller 14 can be driven by the intermediate transfer belt 10 in such a way as to rotate around its rotational axis in a direction identical to the moving direction of the intermediate transfer belt 10. The metallic roller 14 is disposed on an inner circumferential surface side of the intermediate transfer belt 10. The metallic roller 14 contacts a predetermined area of the intermediate transfer belt 10 in the longitudinal direction perpendicular to the moving direction of the intermediate transfer belt 10.

In FIG. 3A, W represents a distance between the photosensitive drum 1*b* of the second image forming station "b" and the photosensitive drum 1*c* of the third image forming station "c", T represents a distance between the metallic roller 14 and respective photosensitive drums 1*b* and 1*c*, H1 represents a lift-up height of the metallic roller 14 relative to the intermediate transfer belt 10. The distance W is a distance between two neighboring shaft centers in the moving direction of the intermediate transfer belt 10. In the present exemplary embodiment, practical dimensions are W=60 mm, T=30 mm, and H1=2 mm.

Figure 3B:
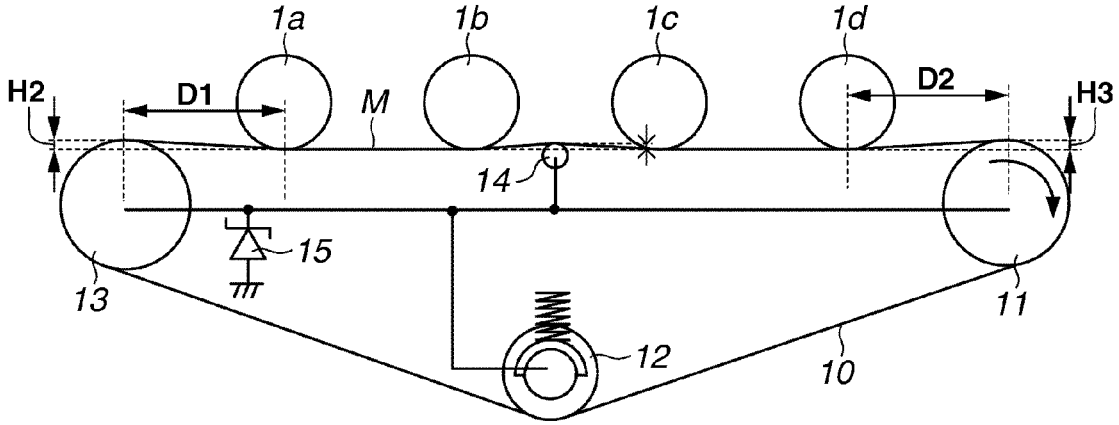

Further, to secure a sufficient length of the intermediate transfer belt 10 to be wound around respective photosensitive drums 1*a* and 1*d*, each of the stretch rollers 11 and 13 is held at a higher position relative to the horizontal surface extending between respective photosensitive drums 1*a*, 1*b*, 1*c*, and 1*d* and the intermediate transfer belt 10, as illustrated in FIG. 3B. Securing the above-mentioned length of the intermediate transfer belt 10 to be wound around respective photosensitive drums 1*a* and 1*d* brings an effect of suppressing the transfer defect that may occur when the contact between respective photosensitive drums 1*a* and 1*d* and the intermediate transfer belt 10 is unstable.

In FIG. 3B, D1 represents a distance between the stretch roller 13 and the photosensitive drum 1*a*, D2 represents a distance between the stretch roller 11 and the photosensitive drum 1*d*, H2 represents a lift-up height of the stretch roller 13 relative to the intermediate transfer belt 10, and H3 represents a lift-up height of the stretch roller 11 relative to the intermediate transfer belt 10. In the present exemplary embodiment, practical dimensions are D1=D2=50 mm, and H2=H3=2 mm.

The intermediate transfer belt 10 used in the present exemplary embodiment has a 700 mm peripheral length and a 90 μm thickness. The intermediate transfer belt 10 is made of an endless polyimide resin mixed with conducting carbon agent. The intermediate transfer belt 10 has electron conductivity characteristics, characterized in that a variation in resistance value is smaller when the ambient temperature/humidity changes.

Further, in the present exemplary embodiment, the material of the intermediate transfer belt 10 is not limited to the polyimide resin. Any other thermoplastic resin material, such as polyester, polycarbonate, polyarylate, Acrylonitrile-Butadiene-Styrene copolymer (ABS), polyphenylene sulfide (PPS), polyvinylidene fluoride (PVDF), or a mixture resin thereof, is usable. Further, the conducting agent is not limited to carbon. For example, conductive metallic oxide particles are usable.

A volume resistivity rate of the intermediate transfer belt 10 according to the present exemplary embodiment is $1\times10^{9}$ Ω·cm. A combination of Hiresta-UP (MCP-HT450) and ring probe type UR (MCP-HTP12 model) provided by Mitsubishi Chemical, Japan is usable as an instrument set for volume resistivity rate measurement. In measuring the volume resistivity rate, the indoor temperature is set to 23° C. and the indoor humidity is set to 50%. The applied voltage is 100 [V], and the measurement time is 10 seconds. The volume resistivity rate of the intermediate transfer belt 10 usable in the present exemplary embodiment is in a range from $1\times10^{7}$ to $1\times10^{10}$ Ω·cm.

The volume resistivity rate is a barometer of electric conductivity of the intermediate transfer belt 10. The resistance value in the circumferential direction has an important role in determining whether the intermediate transfer belt 10 can form a desired primary transfer potential when current actually flows in the circumferential direction (which is hereinafter referred to as an "electrically conductive belt").

Figure 4A:
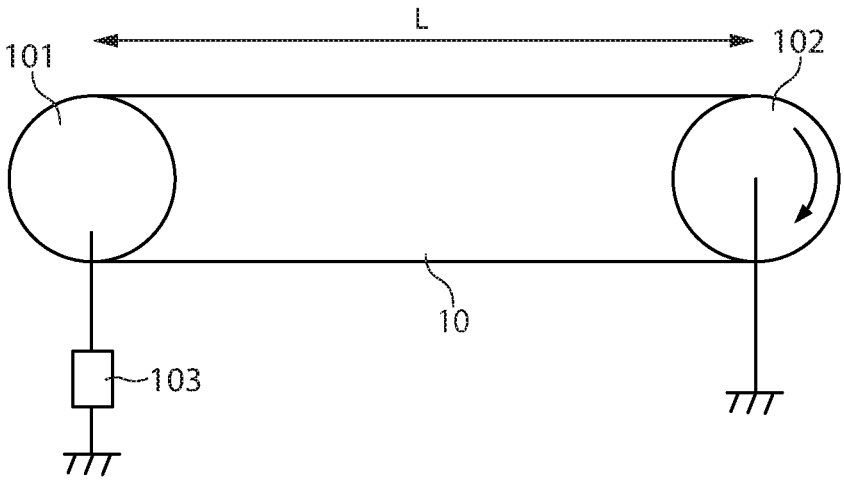
FIGS. 4A and 4B illustrate a measuring system that measures an intermediate transfer belt resistance in the circumferential direction according to the first exemplary embodiment.

FIG. 4A illustrates a circumferential resistance measurement jig, which is usable to measure the resistance in the circumferential direction of the intermediate transfer belt 10. The measurement jig illustrated in FIG. 4A includes an internal roller 101 and a driving roller 102 that cooperatively stretch the intermediate transfer belt 10 to be measured without causing any slack. The internal roller 101, which is made of a metal material, is connected to a high-voltage power source 103 (e.g., a high-voltage power source Model_610E provided by TREK JAPAN Co., Ltd.). The driving roller 102 is connected to the earth. A surface of the driving roller 102 is coated with a conductive rubber whose resistance value is sufficiently lower than that of the intermediate transfer belt 10. The driving roller 102 rotates around its rotational axis in such a way as to cause the intermediate transfer belt 10 to move at a 100 mm/sec traveling speed.

Next, a measurement method is described below. The method includes supplying constant current $I_L$ to the internal roller 101 in a state where the intermediate transfer belt 10 is driven by the driving roller 102 to move at the 100 mm/sec traveling speed. The method further includes monitoring voltage $[V_L]$ with the high-voltage power source 103, which is connected to the internal roller 101.

Figure 4B:
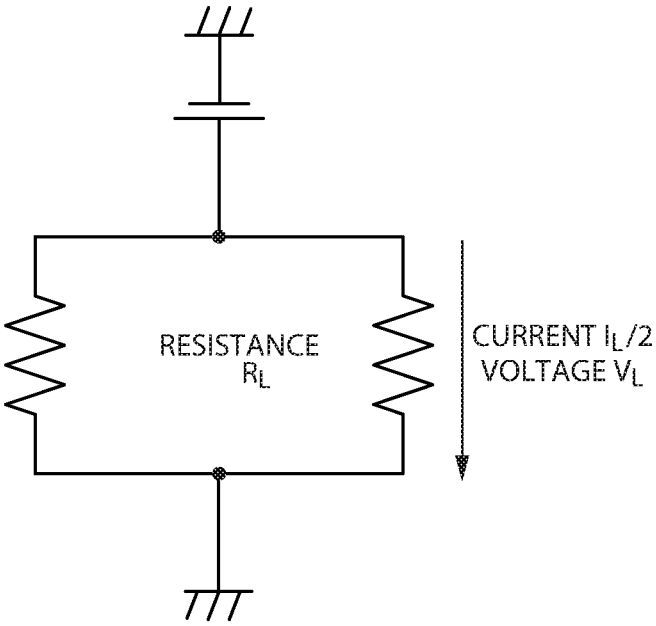

FIG. 4B illustrates an equivalent circuit of the measuring system illustrated in FIG. 4A. In FIG. 4B, $R_L$ $(=2[V_L]/I_L)$ represents a resistance in the circumferential direction of the intermediate transfer belt 10 in a region corresponding to a distance L (300 mm in the present exemplary embodiment) between the internal roller 101 and the driving roller 102. The method further includes converting the calculated resistance $R_L$ into a value corresponding to an intermediate transfer belt peripheral length that is comparable to
100 mm of the intermediate transfer belt 10 to obtain the resistance in the circumferential direction. It is desired that the resistance in the circumferential direction is equal to $1\times10^{9}$Ω or less to cause current to flow from the current supply member to each photosensitive drum 1*a*, 1*b*, 1*c* and 1*d* via the intermediate transfer belt 10.

The intermediate transfer belt 10 used in the present exemplary embodiment has a $1\times10^{8}$Ω resistance in the circumferential direction, which can be obtained by the above-mentioned measurement method. The constant current $I_L$ used in the measurement of the intermediate transfer belt 10 according to the present exemplary embodiment is 5 μA. The monitoring voltage $[V_L]$ obtained in the measurement is 750 [V]. The monitoring voltage $[V_L]$ is a mean value of the measurement value obtainable in the entire circumferential length of the intermediate transfer belt 10. Further, as the resistance $R_L$ in the circumferential direction of the intermediate transfer belt 10 can be defined by the formula $R_L=2\ [V_L]/I_L$, the resistance $R_L$ is equal to $2\times750/(5\times10^{-6})=3\times10^{8}$Ω. Thus, the resistance in the circumferential direction is equal to $1\times10^{8}$Ω, which can be obtained by converting the obtained resistance $R_L$ into a value corresponding to 100 mm of the intermediate transfer belt 10.

The intermediate transfer belt 10 used in the present exemplary embodiment is an electrically conductive belt that causes current to flow in the circumferential direction as mentioned above.

A primary transfer potential forming method for performing a primary transfer operation according to the present exemplary embodiment is described in detail below. According to the configuration of the present exemplary embodiment, the transfer power source 21, which applies a predetermined voltage to the secondary transfer member 20, is usable as a transfer power source for performing the primary transfer operation. More specifically, the transfer power source 21 is commonly usable for the primary transfer and the secondary transfer.

The secondary transfer roller 20 is operable as the current supply member according to the present exemplary embodiment. The secondary transfer counter roller 13 is operable as the counter member according to the present exemplary embodiment. When the transfer power source 21 can be used as a common transfer power source as mentioned above, it is feasible to reduce costs of the image forming apparatus because it is unnecessary to provide a transfer power source dedicated to the primary transfer.

When the transfer power source 21 applies the voltage to the secondary transfer roller 20, current flows from the secondary transfer roller 20 to the intermediate transfer belt 10. The current flowing through the intermediate transfer belt 10 charges the intermediate transfer belt 10 while the current flows in the circumferential direction of the intermediate transfer belt 10, in such away as to form the primary transfer potential at each primary transfer portion. When a potential difference is generated between the primary transfer potential and the photosensitive drum potential, toners of respective photosensitive drums 1*a*, 1*b*, 1*c*, and 1*d* move to the intermediate transfer belt 10 to realize the primary transfer operation.

Figure 5:
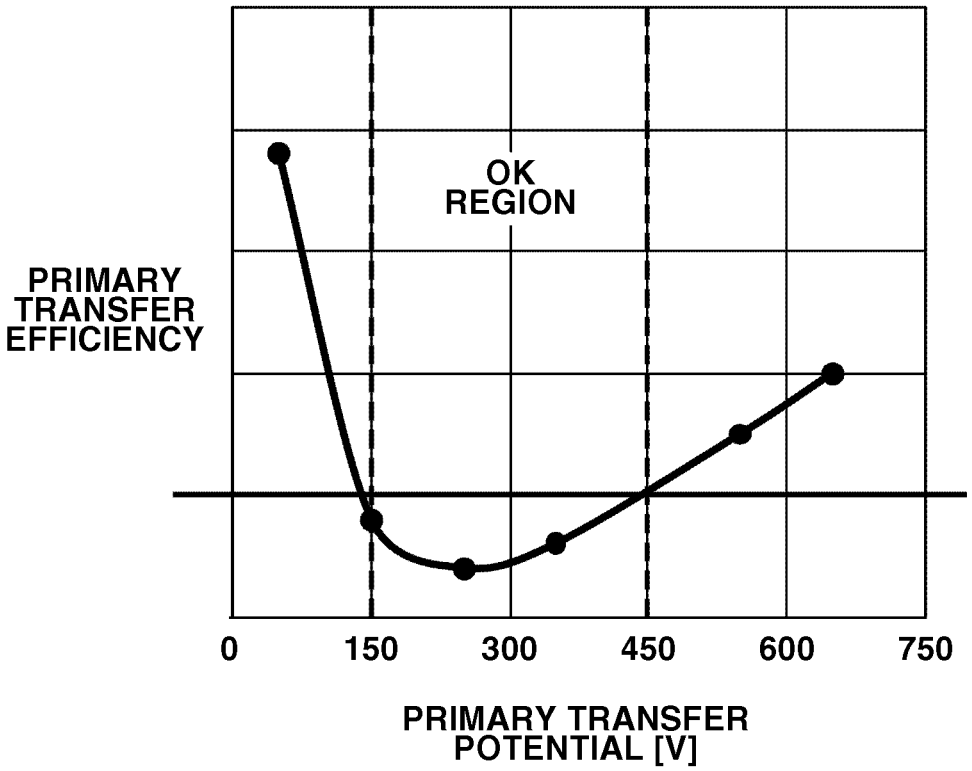
FIG. 5 is a graph illustrating a relationship between primary transfer potential and primary transfer efficiency according to the first exemplary embodiment.

FIG. 5 is a graph illustrating a relationship between intermediate transfer belt potential and primary transfer efficiency. In FIG. 5, the ordinate refers to a transfer efficiency value, which is a measurement result of primary transfer residue density measured with a Macbeth Transmission Reflection Densitometer (provided by GretagMacbeth). The primary transfer residue density becomes higher when the ordinate value becomes larger. Therefore, the transfer efficiency decreases. In the configuration according to the present exemplary embodiment, as apparent from the graph illustrated in FIG. 5, an area in which a satisfactory primary transfer efficiency can be attained (e.g., an area in which a 95% or more transfer efficiency can be attained) is 150 [V] to 450 [V] in the primary transfer potential.

However, current flows from the intermediate transfer belt 10 to respective photosensitive drums 1*a*, 1*b*, 1*c*, and 1*d* at respective primary transfer portions in the primary transfer operation. Therefore, it may be difficult to maintain the primary transfer potential at a desired electric potential. For example, the image forming stations "c" and "d" disposed on the downstream side in the moving direction of the intermediate transfer belt 10 are far from the secondary transfer roller 20 (i.e., the current supply member). Further, an area of the intermediate transfer belt 10 that reaches the downstream side image forming stations "c" and "d" is the area from which current has flowed to photosensitive drums 1*a* and 1*b* of the upstream-side image forming stations "a" and "b."

Therefore, the primary transfer potential at the downstream side transfer portion tends to be lower than the primary transfer potential at the upstream side transfer portion. Further, a voltage drop occurs due to the resistance of the intermediate transfer belt 10 when current flows in the circumferential direction of the intermediate transfer belt 10. Therefore, the primary transfer potential at the downstream side transfer portion tends to be lower than the primary transfer potential at the upstream side transfer portion.

If the current supplied from the secondary transfer roller 20 enables the downstream side image forming stations "c" and "d" to satisfy the primary transfer potential, the primary transfer potential of the upstream side image forming stations "a" and "b" increases and a desired transfer efficiency may not be obtained. Therefore, the desired primary transfer potential cannot be maintained at each primary transfer portion and a transfer defect may occur.

Therefore, the secondary transfer counter roller 13 and the driving roller 11, which cooperatively form the primary transfer surface M of the intermediate transfer belt 10, are connected to the earth via a voltage maintenance element 15. The secondary transfer counter roller 13 and the driving roller 11, which are connected to the voltage maintenance element 15, are maintained at a predetermined potential or more when current flows from the secondary transfer roller 20 (i.e., the current supply member) to the voltage maintenance element 15 via the intermediate transfer belt 10. The predetermined potential is an electric potential having been set beforehand in such a way as to maintain the primary transfer potential required to attain the desired transfer efficiency at each primary transfer portion.

Further, the contact member 14 that contacts the intermediate transfer belt 10 is disposed on a side where the primary transfer surface M of the intermediate transfer belt 10 is formed between the secondary transfer counter roller 13 and the driving roller 11. The contact member 14 used in the present exemplary embodiment is the metallic roller 14. The metallic roller 14 is electrically connected to the earth via the voltage maintenance element 15.

The voltage maintenance element 15 used in the present exemplary embodiment is a Zener diode (i.e., a constant-voltage element). In the following description, a Zener voltage refers to a voltage between an anode and a cathode when an opposite polarity voltage is applied to the Zener diode 15.

When the voltage maintenance element 15 is the Zener diode, it is useful to set the absolute value of the Zener voltage of the Zener diode to be a predetermined potential (e.g., 150 [V]) or more. Accordingly, the Zener voltage is set to 300 [V] to maintain a predetermined voltage or more.

When the voltage is applied from the transfer power source 21 to the secondary transfer roller 20, current flows from the secondary transfer roller 20 to the Zener diode 15, which is grounded, via the intermediate transfer belt 10 and the secondary transfer counter roller 13. In this case, the opposite polarity voltage is applied to the Zener diode 15 because the current flows from a cathode side to an anode side. The anode side of the Zener diode 15 is connected to the earth. Therefore, the cathode side of the Zener diode 15 is maintained at the Zener voltage. Accordingly, the secondary transfer counter roller 13 and the driving roller 11 connected to the cathode side of the Zener diode 15 are maintained at 300 [V]. The metallic roller 14 is connected to the Zener diode 15. Therefore, similar to the secondary transfer counter roller 13 and the driving roller 11, the metallic roller 14 can be maintained at 300 [V].

Accordingly, the metallic roller 14 maintained at the 300 [V] Zener voltage causes at least a partial area of the primary transfer surface M of the intermediate transfer belt 10 to be maintained at the 300 [V] electric potential. Further, when the secondary transfer counter roller 13 and the driving roller 11 are maintained at 300 [V], the intermediate transfer belt 10 can be maintained at the 300 [V] electric potential at both the upstream end position and the downstream end position of the primary transfer surface in the moving direction of the intermediate transfer belt 10.

As mentioned above, the intermediate transfer belt 10 is maintained at the predetermined potential or more at a plurality of positions of the intermediate transfer belt 10. Therefore, even if maintaining the primary transfer potential by the current supplied via a contact portion between the secondary transfer roller 20 and the intermediate transfer belt 10 is difficult, sufficient current can be supplied from a contact portion of the secondary transfer counter roller 13, the driving roller 11, or the metallic roller 14.

In the present exemplary embodiment, the tension roller 12 that applies the tensile force to the intermediate transfer belt 10 is connected to the voltage maintenance element (i.e., the Zener diode 15). The above-mentioned configuration according to the present exemplary embodiment can prevent current from flowing to the earth from the tension roller 12. The tension roller 12 is not the member that contacts the primary transfer surface M of the intermediate transfer belt 10. Therefore, electrically insulating the tension roller 12 is useful.

Figure 6:
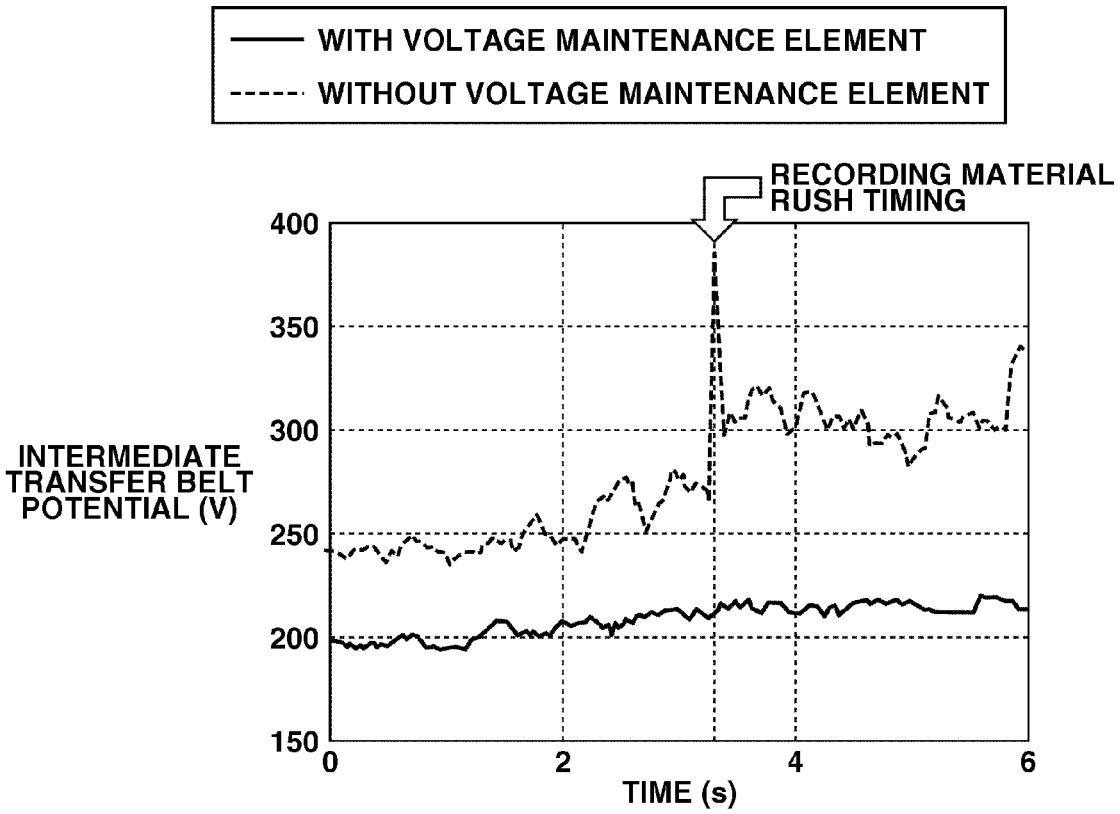
FIG. 6 illustrates temporal changes in intermediate transfer belt potential at the primary transfer portion of a first image forming station before and after rushing of a recording material to a secondary transfer portion.

Connecting the voltage maintenance element 15 to each member as mentioned above brings the following effects. First, connecting the Zener diode 15 to the secondary transfer counter roller 13 brings the following effects. FIG. 6 illustrates measured temporal changes in electric potential at the primary transfer portion of the first image forming station "a" before and after rushing of the recording material P to the secondary transfer portion. In FIG. 6, the ordinate refers to the electric potential at the primary transfer portion of the first image forming station "a" and the abscissa refers to elapsed time.

The measurement result illustrated in FIG. 6 is a temporal change in voltage applied to the intermediate transfer belt 10, which was measured during a secondary transfer process according to the present exemplary embodiment. Instruments used in the measurement include a surface potential measurement apparatus (Model370) and a dedicated probe (Model 3800S-2) provided by TREK JAPAN Co., Ltd. The measurement performed in a state where the Zener diode 15 was connected to the secondary transfer counter roller 13 includes monitoring the electric potential of a metallic roller (not illustrated) disposed at a position spaced from the secondary transfer counter roller 13 via the intermediate transfer belt 10 to measure the surface potential of the intermediate transfer belt 10.

A dotted line in FIG. 6 indicates a referential measurement result obtained in a condition where the Zener diode 15 is not connected to the secondary transfer counter roller 13. A solid line in FIG. 6 indicates the measurement result obtained in a condition where the Zener diode 15 is connected to the secondary transfer counter roller 13.

If constant-current control is in progress when the recording material P rushes to the secondary transfer portion, the amount of current supplied from the secondary transfer roller 20 instantaneously increases. In this case, excessive current (i.e., a part of the current applied from the secondary transfer roller 20) can flow through the Zener diode 15 via the intermediate transfer belt 10 and the secondary transfer counter roller 13. The surface potential of the intermediate transfer belt 10 can be stabilized at a desired level (e.g., 200 [V]).

However, in the comparative case where the Zener diode 15 is not connected to the secondary transfer counter roller 13, the above-mentioned effect cannot be obtained. Therefore, after the rushing of the recording material P to the secondary transfer portion, the intermediate transfer belt potential at the primary transfer portion of the first image forming station "a" causes significant variations.

As mentioned above, connecting the Zener diode 15 to the secondary transfer counter roller 13 brings the effect of stably maintaining the intermediate transfer belt potential at the primary transfer portion of the first image forming station "a" even if secondary transfer current suddenly changes when the recording material P has reached the secondary transfer portion.

Next, connecting the Zener diode 15 to the metallic roller 14 (i.e., the member disposed in the area corresponding to the primary transfer surface) brings the following effects. Comparable examples are used to verify the effects.

Similar to the intermediate transfer belt 10 described in the present exemplary embodiment, an intermediate transfer belt used in each comparable example is an electrically conductive belt that has a $1\times10^8\Omega$ resistance in the circumferential direction. An image forming apparatus used in each comparable example has a 100 mm/sec process speed. To confirm the effects, the intermediate transfer belt potential at each image forming station during a primary transfer operation was measured in the present exemplary embodiment and each of the following two comparable examples. Instruments used in the intermediate transfer belt potential measurement include the surface potential measurement apparatus (Model370) and the dedicated probe (Model 3800S-2) provided by TREK JAPAN Co., Ltd. The intermediate transfer belt potential was measured on a back surface of the intermediate transfer belt 10 at each primary transfer portion.

Figure 7:
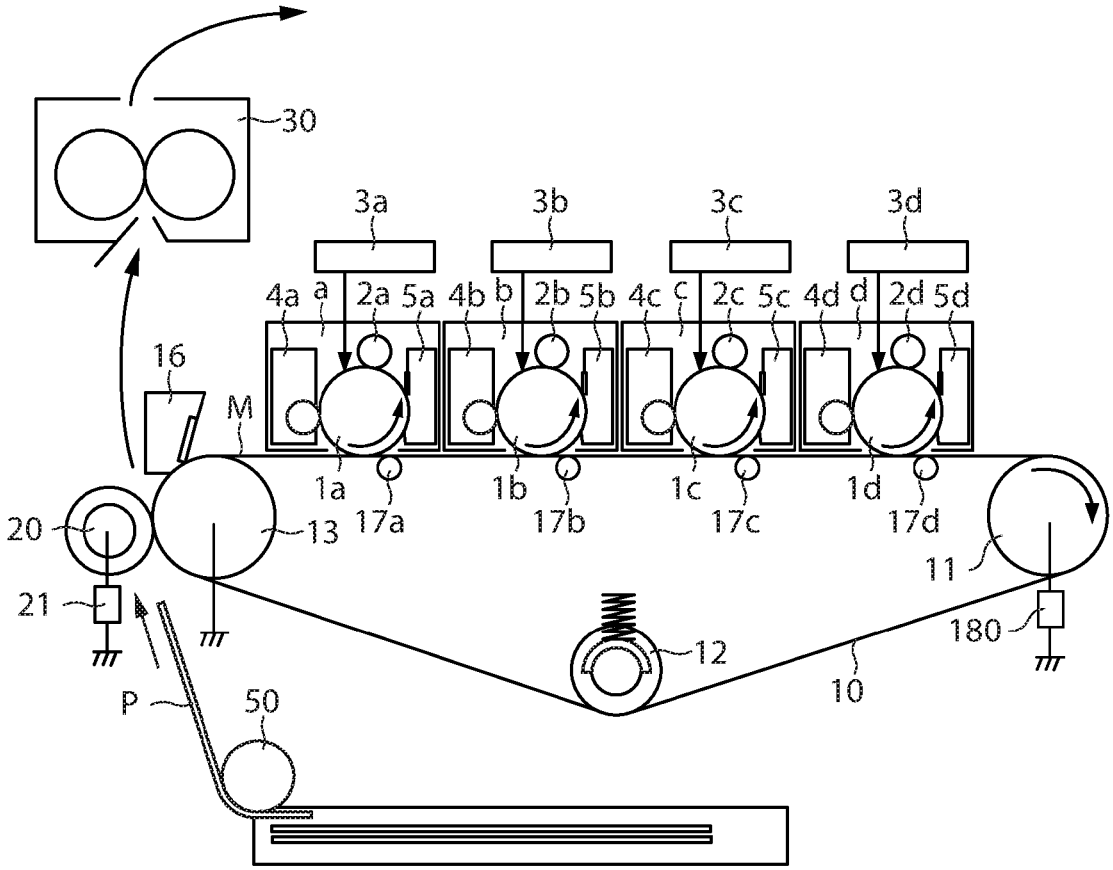
FIG. 7 schematically illustrates an image forming apparatus according to a comparable example 1.
Figure 8:
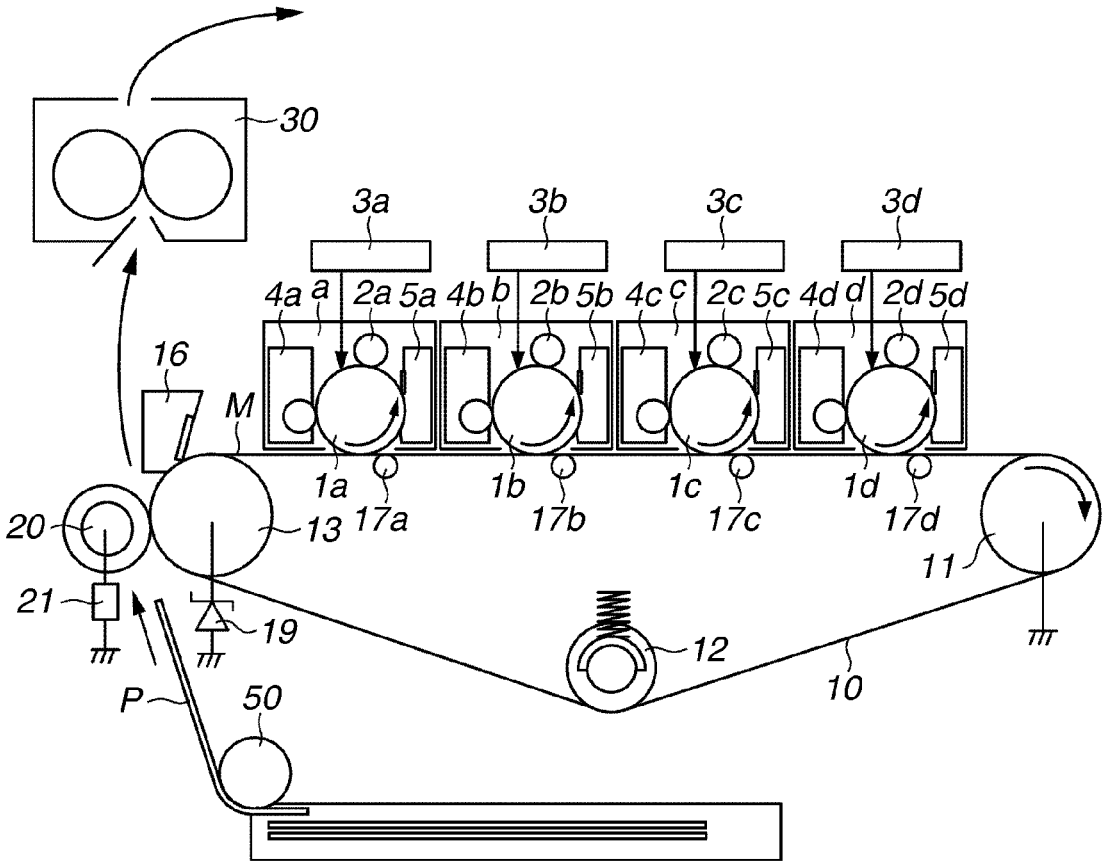
FIG. 8 schematically illustrates an image forming apparatus according to a comparable example 2.

FIGS. 7 and 8 illustrate configurations of respective comparable examples. Evaluation results of the comparable examples are described in detail below with reference to Table 1.

Comparable Example 1

According to the configuration of an image forming apparatus illustrated in FIG. 7, the secondary transfer counter roller 13 (i.e., the member that forms the primary transfer surface) M is electrically connected to the earth and a transfer power source dedicated to the primary transfer is connected to the driving roller 11. Thus, current flows from the transfer power source 180 connected to the driving roller 11 to the secondary transfer counter roller 13 via the intermediate transfer belt 10, in such a way as to generate the primary transfer potential at each primary transfer portion for the primary transfer.

Roller members 17*a*, 17*b*, 17*c*, and 17*d* are disposed at counter regions where the intermediate transfer belt 10 faces the photosensitive drums 1*a*, 1*b*, 1*c*, and 1*d* of respective stations "a" to "d". Each roller member 17*a*, 17*b*, 17*c*, and 17*d* brings the intermediate transfer belt 10 into contact with a corresponding photosensitive drum 1*a*, 1*b*, 1*c*, and 1*d* to form the primary transfer portion. Respective roller members 17*a*, 17*b*, 17*c*, and 17*d*, which are kept in an electrically floating state, include a metallic roller having a 5 mm diameter and an elastic sponge having a 2 mm thickness that covers the metallic roller. Respective roller members 17*a*, 17*b*, 17*c*, and 17*d* are driven by the intermediate transfer belt 10 in such a way as to rotate around its rotational axis in synchronization with the rotation of the intermediate transfer belt 10. The rest of the configuration of the image forming apparatus illustrated in FIG. 7 is similar to that described in the first exemplary embodiment (see FIG. 1).

Comparable Example 2

According to the configuration of an image forming apparatus illustrated in FIG. 8, a Zener diode 19 (having a 300 [V] Zener voltage) is connected to the secondary transfer counter roller 13 (i.e., the member that forms the primary transfer surface M) and the driving roller 11 is electrically connected to the earth. Thus, current flows from the transfer power source 21 to the secondary transfer counter roller 13 via the intermediate transfer belt 10. The Zener diode 19 connected to the secondary transfer counter roller 13 can be maintained at 300 [V]. Further, the current from the secondary transfer roller 20 flows in the circumferential direction of the intermediate transfer belt 10, in such a way as to generate the primary transfer potential at each primary transfer portion for the primary transfer.

At this moment, the secondary transfer counter roller 13 has an electric potential that corresponds to the Zener diode 19 (i.e., 300 [V]). Starting with the above-mentioned electric potential, the image forming apparatus performs a primary transfer operation according to the intermediate transfer belt potential at each image forming station "a" to "d". Similar to the comparable example 1, the roller members 17*a*, 17*b*, 17*c*, and 17*d* are disposed at counter regions corresponding to the photosensitive drums 1*a*, 1*b*, 1*c*, and 1*d* of respective stations. The rest of the configuration of the image forming apparatus illustrated in FIG. 8 is similar to that described in the comparable example 1.

Next, the evaluation results are described below. Table 1 illustrates measurement results of the intermediate transfer belt potential during image forming operations according to the above-mentioned exemplary embodiment and two comparable examples.

According to the configuration of the comparable example 1, a voltage drop occurs due to the resistance of the intermediate transfer belt 10 when the current flows from the driving roller 11 to the secondary transfer counter roller 13. Further, a voltage drop occurs when the current leaks via each photosensitive drum 1*a*, 1*b*, 1*c*, and 1*d*. Therefore, the primary transfer potential of the image forming station "a" (i.e., the image forming station positioned near the secondary transfer counter roller 13) becomes lower than the primary transfer potential of the image forming station "d" (i.e., the image forming station positioned near the driving roller 11).

For example, in the configuration of the comparable example 1, if a 600 [V] voltage is applied from the transfer power source 180 to set the primary transfer potential of the image forming station "a" to be 150 [V] or more, the intermediate transfer belt potential at the fourth image forming station "d" (black) becomes a very high value (e.g., 500 [V]) because the fourth image forming station "d" is positioned near the transfer power source 180. As illustrated in FIG. 5, the transfer efficiency deteriorates if the intermediate transfer belt potential deviates from the desired electric potential area. The transfer field formed in this case is so strong that a discharge of electricity occurs in the primary transfer portion. The discharge changes the polarity of toners to be transferred. As a result, the amount of toner particles to be transferred to the intermediate transfer belt 10 decreases and a defect in density occurs in the fourth image forming station "d" (black).

According to the configuration of the comparable example 2, current flows from the secondary transfer roller 20 to the Zener diode 19 connected to the secondary transfer counter roller 13 via the intermediate transfer belt 10. When the flowing current is equal to a constant amount or more, the Zener diode 19 maintains the 300 [V] Zener voltages and also maintains the secondary transfer counter roller 13 the 300 [V] voltages. Therefore, the first image forming station "a" (i.e., the upstream station) can maintain the 200 [V] intermediate transfer belt potential.

However, the intermediate transfer belt potential at each downstream station decreases to a level lower than the predetermined potential (150 [V]). As a result, a transfer defect occurs at the third image forming station "c" (cyan) and the fourth image forming station "d" (black) because of weakness of the transfer field.

The configuration according to the present exemplary embodiment (see FIG. 1) is different in that the metallic roller 14 is disposed between the second image forming station "b" and the third image forming station "c", and the rollers 11, 12, and 13 that cooperatively stretch the intermediate transfer belt 10 are connected to the earth via the Zener diode 15. Thus, the configuration according to the present exemplary embodiment can maintain the 300 [V] Zener voltages at each roller portion.

Table 1 lists electric potentials at the 1st to 4th primary transfer portions according to the comparable example 1, the comparable example 2, and the present exemplary embodiment. As illustrated in table 1, the configuration according to the present exemplary embodiment is excellent in that the variation at each primary transfer portion can be suppressed in such a manner that all of the primary transfer potentials can be maintained at the predetermined potential (150 [V]) or more (i.e., the electric potential required in attaining the desired transfer efficiency).

TABLE 1

| | $1^{st}$ | $2^{nd}$ | $3^{rd}$ | $4^{th}$ |
|---|---|---|---|---|
| Comparable example 1 | 200 [V] | 200 [V] | 400 [V] | 500 [V] |
| Comparable example 2 | 200 [V] | 150 [V] | 100 [V] | 50 [V] |
| Exemplary embodiment | 180 [V] | 220 [V] | 220 [V] | 150 [V] |

As mentioned above, the image forming apparatus according to the present exemplary embodiment includes the metallic roller 14 connected to the Zener diode 15 at an intermediate position between the second image forming station "b" and the third image forming station "c", as a partial element of the primary configuration for forming the primary transfer potential by causing current to flow in the circumferential direction of the intermediate transfer belt 10. Thus, the image forming apparatus according to the present exemplary embodiment can prevent the primary transfer potential from varying at each primary transfer portion and cause current to flow from the current supply member to the intermediate transfer belt 10, in such a way as to secure satisfactory primary transfer characteristics.

As mentioned above, the metallic roller 14 used in the present exemplary embodiment is made of the nickel-plated SUS bar. However, the metallic roller 14 is not limited to the above-mentioned example. For example, the metallic roller 14 can be made of other metal (e.g., aluminum or iron) or can be an electrically conductive resin roller. Further, the metallic roller 14 can be coated with an elastic member because similar effects can be obtained.

The voltage maintenance element 15 used in the present exemplary embodiment to stabilize the intermediate transfer belt potential is the Zener diode 15 (i.e., the constant-voltage element). However, another constant-voltage element (e.g., a varistor) that can bring similar effects is usable. Further, a resistance element is usable if it can maintain the primary transfer potential at the predetermined potential or more. For example, it is useful to use a 100 M Ω resistance element. However, in a case where the voltage maintenance element 15 is a resistance element, the electric potential varies depending on the amount of current flowing through the resistance element. Therefore, managing the electric potential becomes difficult compared to the above-mentioned constant-voltage element.

Further, a plurality of voltage maintenance elements 15 are usable. Using a common voltage maintenance element (see the voltage maintenance element 15 described in the present exemplary embodiment) is useful in that all connected members (e.g., the driving roller 11, the secondary transfer counter roller 13, and the metallic roller 14) can be maintained at the same potential. Furthermore, a potential difference may be applied between the connected member provided with a resistance element and the connected member provided with no resistance element, by providing a resistance element between an arbitrary connected member and the voltage maintenance element 15.

Figure 9:
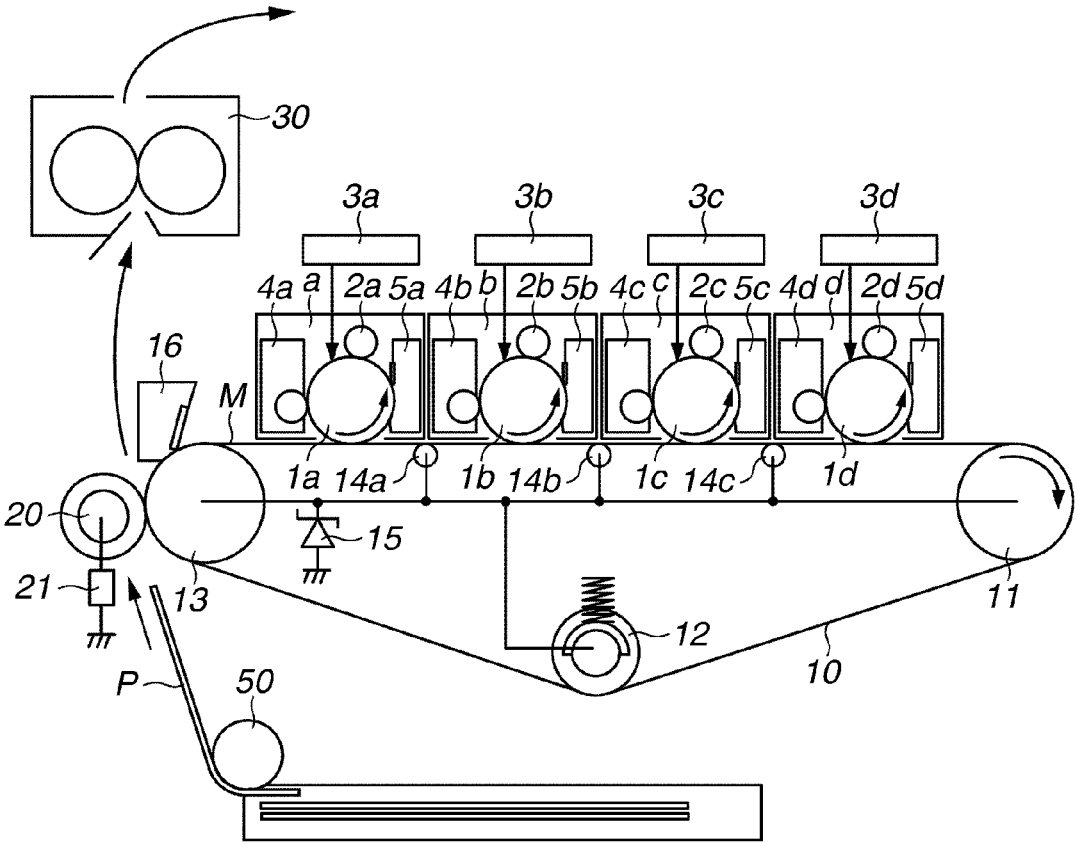
FIG. 9 illustrates another configuration of the image forming apparatus according to the first exemplary embodiment.

Further, as mentioned above, only one metallic roller (i.e., the metallic roller 14) is disposed between the second image forming station "b" and the third image forming station "c." However, the metallic roller 14 can be disposed at any position between the first image forming station "a" and the fourth image forming station "d". Further, as illustrated in FIG. 9, a plurality of metallic rollers 14*a*, 14*b*, and 14*c* can be disposed between the first image forming station "a" and the fourth image forming station "d." More specifically, the metallic roller 14*a* is disposed between the first image forming station "a" and the second image forming station "b." The metallic roller 14*b* is disposed between the second image forming station "b" and the third image forming station "c." Further, the metallic roller 14*c* is disposed between the third image forming station "c" and the fourth image forming station "d."

As described in the present exemplary embodiment, when only one metallic roller 14 is disposed between the second image forming station "b" and the third image forming station "c", an area that maintains the predetermined potential or more can be formed at substantially the center of the primary transfer surface M. In other words, it is feasible to prevent the primary transfer potential from varying even when the number of metallic rollers 14 is small.

Further, the contact member 14 can be disposed between the secondary transfer counter roller 13 and the driving roller 11 that cooperatively form the primary transfer surface M of the intermediate transfer belt 10 in such a manner that the contact member 14 contacts an outer circumferential surface of the intermediate transfer belt 10. For example, as a method for bringing the contact member 14 into contact with the outer circumferential surface of the intermediate transfer belt 10, the contact member 14 can be disposed at an end of the intermediate transfer belt 10 in the longitudinal direction.

Figure 10:
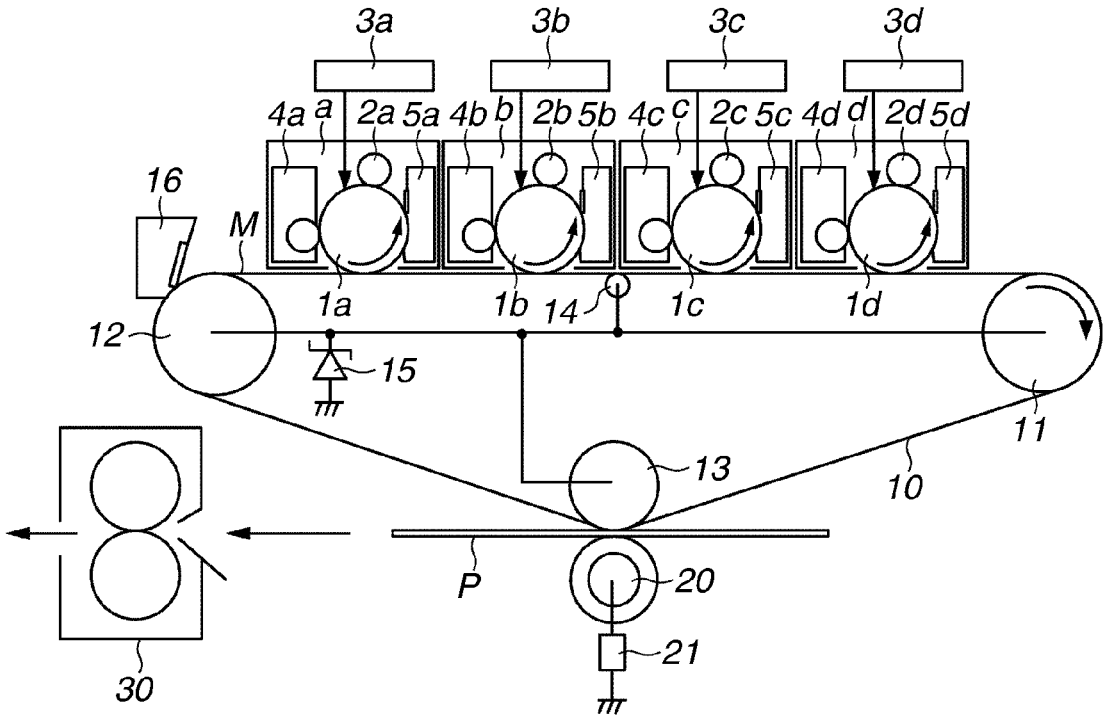
FIG. 10 illustrates another configuration of the image forming apparatus according to the first exemplary embodiment.

Further, as an employable arrangement, the current supply member can be disposed so as not to face the stretch member 13 that forms the primary transfer surface M. For example, it is useful to employ an image forming apparatus illustrated in FIG. 10, in which the secondary transfer counter roller 13 is not brought into contact with the primary transfer surface M even though the current supply member is the secondary transfer roller 20 and the counter member is the secondary transfer counter roller 13. Even in the configuration illustrated in FIG. 10, current can be directly supplied from the secondary transfer roller 20 to the Zener diode 15 via the intermediate transfer belt 10 and the secondary transfer counter roller 13. Therefore, the metallic roller 14 that contacts the primary transfer surface M can be maintained at the predetermined potential or more.

A relationship between the belt potential in the primary and secondary transfer operations and the secondary transfer voltage generated by the transfer power source 21 in an image forming operation according to the present exemplary embodiment is described in detail below with reference to a timing chart illustrated in FIG. 11.

In response to an image signal supplied from the controller 100, the image forming apparatus starts an image forming operation. The transfer control unit 201 controls the transfer power source 21 to start applying a voltage V2 at timing S1 before starting the primary transfer operation. Thus, an electric potential V1 is formed at each primary transfer portion. The electric potential V1 is equal to or greater than the primary transfer potential required in attaining the desired transfer efficiency. In the present exemplary embodiment, the transfer voltage V2 is set to 2000 Vas a setting for forming the electric potential V1.

Subsequently, at timing S2, the first image forming station "a" starts the primary transfer operation (namely, toner images are successively transferred from the photosensitive drums 1*a* to the intermediate transfer belt 10). At timing S3, the toner images carried by the intermediate transfer belt 10 reach the secondary transfer portion. At this moment, the transfer control unit 201 causes the transfer power source 21 to change the transfer voltage to a voltage V3 that is required to perform the secondary transfer operation. Thus, the toner images can be transferred to a recording material p. For example, the transfer voltage V3 set at this moment is 2500 V.

Next, at timing S4, the image forming apparatus terminates the primary transfer operation. Subsequently, at timing S5, the image forming apparatus terminates the secondary transfer operation (namely, terminates the image forming operation).

Figure 11:
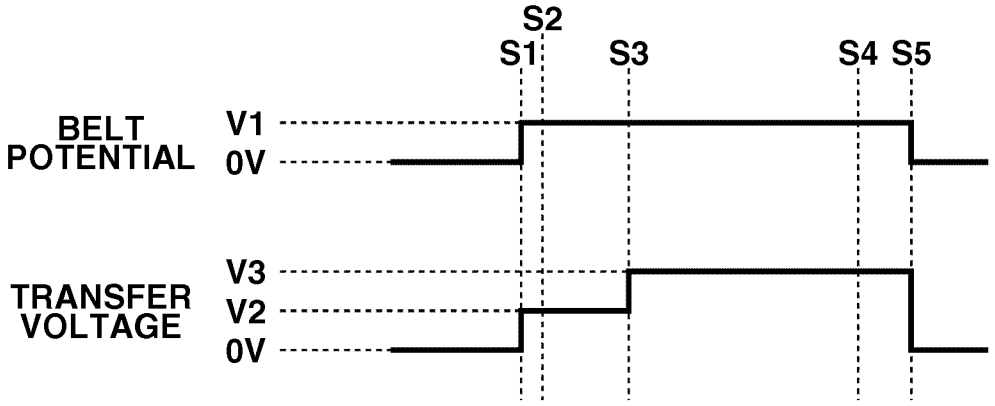
FIG. 11 illustrates a relationship between image forming belt potential and transfer power source voltage according to the first exemplary embodiment.

Even when the transfer control unit 201 controls the transfer power source 21 to change its output voltage according to each phase of the image forming operation as illustrated in FIG. 11, the electric potential of the intermediate transfer belt 15 can be maintained by the voltage maintenance element.

According to the example illustrated in FIG. 11, the transfer control unit 201 performs constant-voltage control for the transfer power source 21. Alternatively, the transfer control unit 201 can perform constant-current control so that constant current flows.

Further, each photosensitive drum surface deteriorates if respective photosensitive drums 1*a*, 1*b*, 1*c*, and 1*d* are repetitively subjected to the electric discharge of the charging roller 2*a*, 2*b*, 2*c*, and 2*d* for a long time. Further, the film thickness of the photosensitive drum surface gradually decreases due to frictional engagement with the cleaning unit 5*a*, 5*b*, 5*c*, and 5*d*. If photosensitive drums 1*a*, 1*b*, 1*c*, and 1*d* that are mutually different in usage state (e.g., cumulative number of rotations) are combined as a drum set, these photosensitive drums 1*a*, 1*b*, 1*c*, and 1*d* are not the same in the film thickness.

If a constant charging voltage Vcdc is applied to respective photosensitive drums 1*a*, 1*b*, 1*c*, and 1*d* in this state, a charging electric potential Vd of the photosensitive drum surface generally varies because of the difference in a potential difference caused in an air gap between the charging roller 2*a*, 2*b*, 2*c*, and 2*d* and the photosensitive drum 1*a*, 1*b*, 1*c*, and 1*d*. If the charging electric potential Vd of each photosensitive drum surface varies, the transfer contrast (i.e., a potential difference between the photosensitive drum 1*a*, 1*b*, 1*c*, and 1*d* and the intermediate transfer belt 10 at the primary transfer portion) varies correspondingly.

As a possible method, it may be useful to change the electric potential of each primary transfer portion according to a variation in the charging electric potential Vd. However, in the configuration according to the present exemplary embodiment, arbitrarily setting the electric potential of the primary transfer portion at each image forming station "a" to "d" is difficult.

Therefore, as another possible method, the controller 100 can change the charging voltage of respective charging rollers 2*a*, 2*b*, 2*c*, and 2*d* depending on the operating environment or usage state in such a way as to equalize the charging electric potential Vd of the photosensitive drum surface. In this case, the primary transfer contrast can be appropriately maintained at each primary transfer portion.

Further, as a method for reducing costs, a common charging power source can be provided to output the charging voltage to each charging roller 2*a*, 2*b*, 2*c*, and 2*d*. In this case, it is useful that the controller 100 controls respective exposure units 3*a*, 3*b*, 3*c*, and 3*d*. When the exposure units 3*a*, 3*b*, 3*c*, and 3*d* form electrostatic latent images according to an image signal, the photosensitive drum potential can be stabilized by uniformly exposing non-image surface areas of respective photosensitive drums 1*a*, 1*b*, 1*c*, and 1*d* to weak light.

Figure 12:
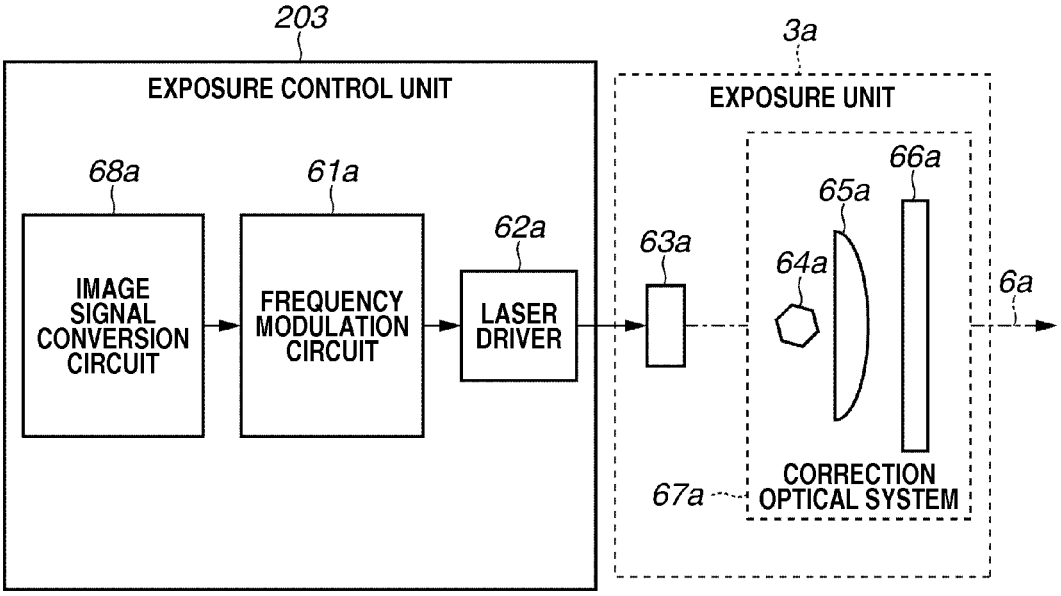
FIG. 12 illustrates an exposure control unit and an exposure unit.

As an example of the weak exposure of the non-image surface area, an operation that can be performed by the exposure unit 3*a* of the first image forming station "a" is described in detail below with reference to FIG. 12. The image signal transmitted from the controller 100 in FIG. 12 is a multi-valued signal (0 to 255) having 8-bit (=256) gradations in the depth direction. When the image signal value is 0, the laser beam is OFF. When the image signal value is 255, the laser beam is fully ON. If the image signal has an intermediate value (i.e., any one of 1 to 254), the laser beam has an intermediate power corresponding to the image signal value.

The exposure level at a non-image portion can be arbitrarily set depending on the level of the multi-valued signal. In the following description, it is presumed that the level of the multi-valued signal is set to 32 when the non-image portion is exposed. The image signal transmitted from the controller 100, if the signal value is 0 (which indicates a non-image portion), is converted into 32 by an image signal conversion circuit 68*a* provided in the exposure control unit 203. The image signal, if its value is any one of 1 to 255, is compression converted into a corresponding one of 33 to 255.

Subsequently, the output of the signal conversion circuit 68*a* is converted into a serial time-axis direction signal by a frequency modulation circuit 61*a*. In the present exemplary embodiment, the signal converted by the frequency modulation circuit 61*a* can be used in pulse width modulation of each dot pulse having a 600 dot/inch resolution.

A laser driver 62*a* is driven in response to the output signal of the frequency modulation circuit 61*a*. The laser driver 62*a* causes a laser diode 63*a* to emit a laser beam 6*a*. The laser beam 6*a* passes through a correction optical system 67*a* and reaches the photosensitive drum 1*a* as scanning light. The correction optical system 67*a* includes a polygon mirror 64*a*, a lens 65*a*, and a bend mirror 66*a*. As a modified example, the frequency modulation circuit 61*a* can be provided in the controller (i.e., the device separated from the laser driver 62*a*).

As mentioned above, exposing the non-image portions to light is effective to stabilize the photosensitive drum potential. Thus, the primary transfer operation can be appropriately performed even when the film thickness of each photosensitive drum 1*a*, 1*b*, 1*c*, and 1*d* changes.

In the above-mentioned first exemplary embodiment, the voltage maintenance element 15 is connected to the secondary transfer counter roller 13, the driving roller 11, and the metallic roller 14 so that the electric potential can be prevented from varying at each primary transfer portion. To the contrary, a plurality of contact members 23*a*, 23*b*, 23*c*, and 23*d* are provided in a second exemplary embodiment. The total number of the contact members 23*a*, 23*b*, 23*c*, and 23*d* to be provided corresponds to the number of image carriers (i.e., the photosensitive drums 1*a*, 1*b*, 1*c*, and 1*d*). The voltage maintenance element 15 is connected to these contact members 23*a*, 23*b*, 23*c*, and 23*d*. The rest of the configuration of the image forming apparatus according to the second exemplary embodiment is similar to that described in the first exemplary embodiment. Therefore, the same reference numbers are allocated to similar members.

Figure 13:
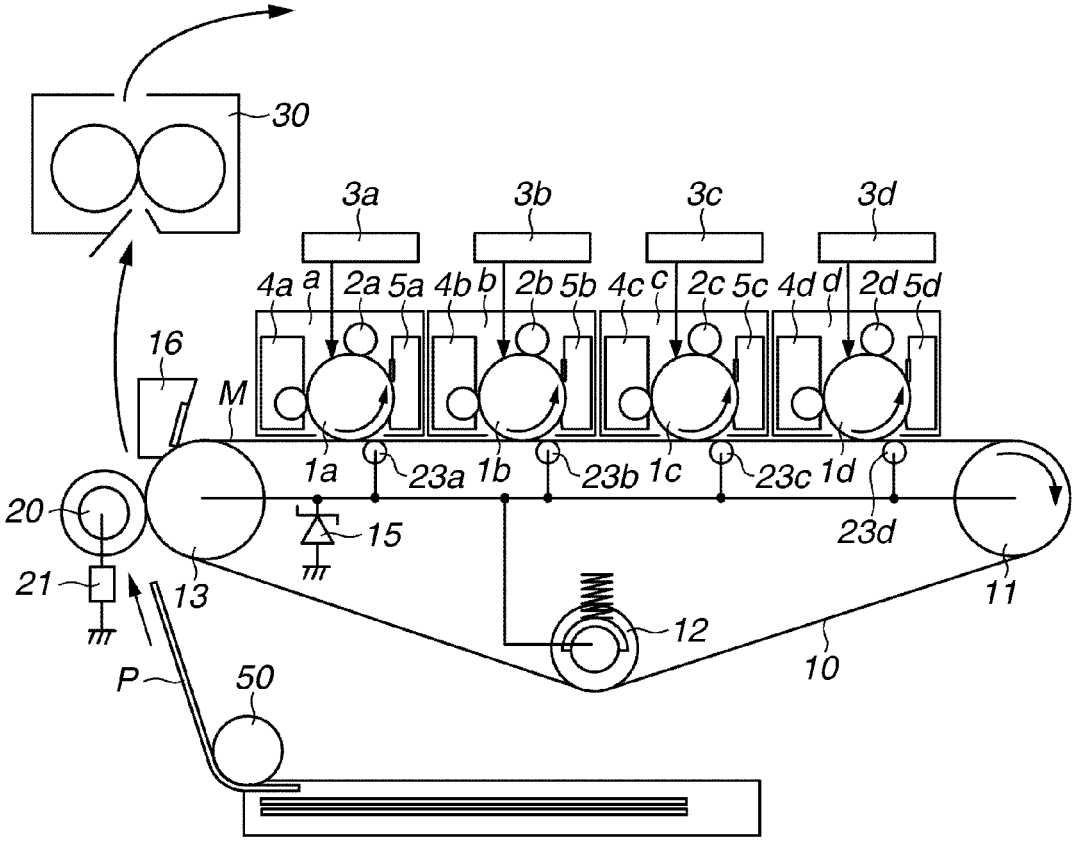
FIG. 13 schematically illustrates an image forming apparatus according to a second exemplary embodiment.

A hardware configuration according to the present exemplary embodiment is described in detail below with reference to FIGS. 13 and 14. FIG. 13 is a schematic sectional view illustrating the image forming apparatus according to the present exemplary embodiment.

As illustrated in FIG. 13, the configuration according to the present exemplary embodiment includes metallic rollers 23*a*, 23*b*, 23*c*, and 23*d* disposed on the downstream side of corresponding primary transfer portions, in such away that the metallic rollers 23*a*, 23*b*, 23*c*, and 23*d* face the corresponding photosensitive drums 1*a*, 1*b*, 1*c*, and 1*d* via the intermediate transfer belt 10. Three stretch rollers 11, 12, and 13 that cooperatively stretch the intermediate transfer belt 10 and the above-mentioned metallic rollers 23*a*, 23*b*, 23*c*, and 23*d* are connected to the earth via the Zener diode 15 (i.e., the constant-voltage element) that is operable as a voltage maintenance element.

A detailed configuration of the above-mentioned metallic roller 23*a* is described below with reference to FIG. 14. FIG. 14 is a partly enlarged configuration of the first image forming station "a" illustrated in FIG. 13. In FIG. 14, the metallic roller 23*a* is disposed on the downstream side of the photosensitive drum 1*a* and offset by 8 mm from the center of the photosensitive drum 1*a* in the moving direction of the intermediate transfer belt 10. Further, a roller bearing of the metallic roller 23*a* is held at a position raised by 1 mm relative to the horizontal surface extending between the photosensitive drums 1*a* and 1*b* and the intermediate transfer belt 10 in such a way as to secure a sufficient length of the intermediate transfer belt 10 wound around the photosensitive drum 1*a*.

The metallic rollers 23*a*, 23*b*, 23*c*, and 23*d* are positioned near but sufficiently spaced from respective photosensitive drums 1*a*, 1*b*, 1*c*, and 1*d* in such a way as to stabilize the intermediate transfer belt potential and prevent the metallic rollers 23*a*, 23*b*, 23*c*, and 23*d* from damaging respective photosensitive drums 1*a*, 1*b*, 1*c*, and 1*d*. In the moving direction of the intermediate transfer belt 10, the metallic roller 23*a*, 23*b*, and 23*c* are positioned on the downstream side of their corresponding primary transfer portions. Further, each metallic roller 23*a*, 23*b*, and 23*c* is positioned closely to the corresponding primary transfer portion and is relatively far from the neighboring photosensitive drum 1*a*, 1*b*, and 1*c* disposed on the downstream side.

Further, the metallic roller 23*d* is positioned on the downstream side of its corresponding primary transfer portion. The metallic roller 23*d* is positioned closely to the corresponding primary transfer portion and is relatively far from the neighboring driving roller 11 disposed on the downstream side.

Figure 14:
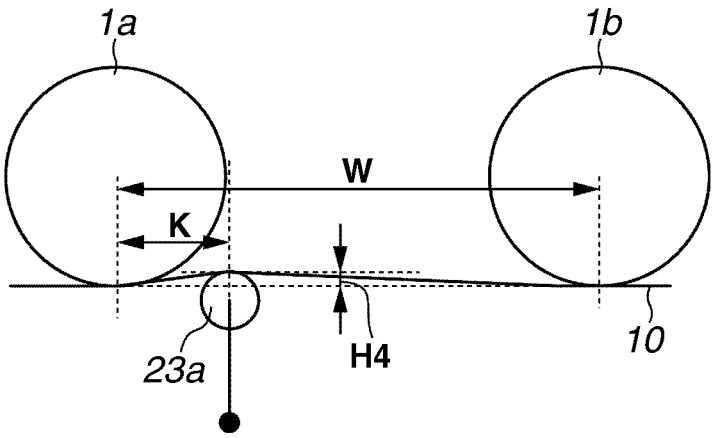
FIG. 14 illustrates a configuration of the primary transfer portion according to the second exemplary embodiment.

In FIG. 14, W represents a distance between the photosensitive drum 1*a* of the first image forming station "a" and the photosensitive drum 1*b* of the second image forming station "b", K represents an offset distance of the metallic roller 23*a* relative to the center of the photosensitive drum 1*a*, and H4 represents a lift-up height of the metallic roller 23*a* relative to the intermediate transfer belt 10. In the present exemplary embodiment, practical dimensions are W=60 mm, K=8 mm, and H4=1 mm.

Similar to the first exemplary embodiment, the metallic roller 23*a* is made of the nickel-plated SUS bar that has the 6 mm outer diameter and extends straight. The metallic roller 23*a* can be driven by the intermediate transfer belt 10 in such a way as to rotate around its rotational axis in a direction identical to the moving direction of the intermediate transfer belt 10. The metallic roller 23*a* contacts a predetermined area of the intermediate transfer belt 10 in the longitudinal direction perpendicular to the moving direction of the intermediate transfer belt 10.

The metallic roller 23*b* disposed on the second image forming station "b", the metallic roller 23*c* disposed on the third image forming station "c", and the metallic roller 23*d* disposed on the fourth image forming station "d" are similar to the metallic roller 23*a* in configuration. The rest of the configuration of the image forming apparatus according to the present exemplary embodiment is similar to that described in the first exemplary embodiment. Therefore, redundant description thereof will be avoided. When the transfer power source 21 applies the voltage to the secondary transfer roller 20, current flows via the intermediate transfer belt 10 to the secondary transfer counter roller 13 (i.e., the secondary transfer counter member). The Zener diode 15 can maintain the Zener voltage while the current flows. When the Zener diode 15 maintains the Zener voltage, respective metallic rollers 23*a*, 23*b*, 23*c*, and 23*d* connected to the Zener diode 15 can maintain the Zener voltage.

The voltage maintenance element (i.e., the Zener diode 15) maintains the metallic rollers 23*a*, 23*b*, 23*c*, and 23*d*, which are disposed near the corresponding primary transfer portions as mentioned above, at a predetermined voltage or more (i.e., 300 [V] or more). Accordingly, an area near each primary transfer portion of the intermediate transfer belt 10 can be maintained at a desired electric potential (e.g., 150 [V]) or more. Thus, the variation of the primary transfer potential at each primary transfer portion can be minimized and satisfactory primary transfer characteristics can be secured.

Further, according to the above-mentioned configuration, the electric potential can be formed for each primary transfer portion. Therefore, an electrically conductive belt having a larger resistance value in the circumferential direction (i.e., a belt whose electric potential varies greatly at respective primary transfer portions) is usable as the intermediate transfer belt 10 in the present exemplary embodiment.

If the intermediate transfer belt 10 has a smaller resistance value, the current flowing through the intermediate transfer belt 10 may so increase that the primarily transferred toner image flies off the intermediate transfer belt 10. On the other hand, if the intermediate transfer belt 10 has a larger resistance value to address the toner flying, the current flowing in the circumferential direction of the intermediate transfer belt 10 significantly decreases although the above-mentioned phenomenon can be suppressed. In this respect, increasing the number of the contact members is useful to realize satisfactory primary transfer.

According to the configuration described in the present exemplary embodiment, each metallic roller 23*a*, 23*b*, 23*c*, and 23*d* is disposed on the downstream side of a corresponding primary transfer portion. In other words, each metallic roller 23*a*, 23*b*, 23*c*, and 23*d* is positioned on the lower belt potential side because the current partly flows into each photosensitive drum 1*a*, 1*b*, 1*c*, and 1*d*. Accordingly, the potential difference to be formed between the primary transfer portion and the metallic roller 23*a*, 23*b*, 23*c*, and 23*d* can be increased and the current can be supplied satisfactorily. In this respect, disposing each metallic roller 23*a*, 23*b*, 23*c*, and 23*d* on the downstream side of the corresponding primary transfer portion is useful rather than disposing each metallic roller 23*a*, 23*b*, 23*c*, and 23*d* on the upstream side.

Figure 15:
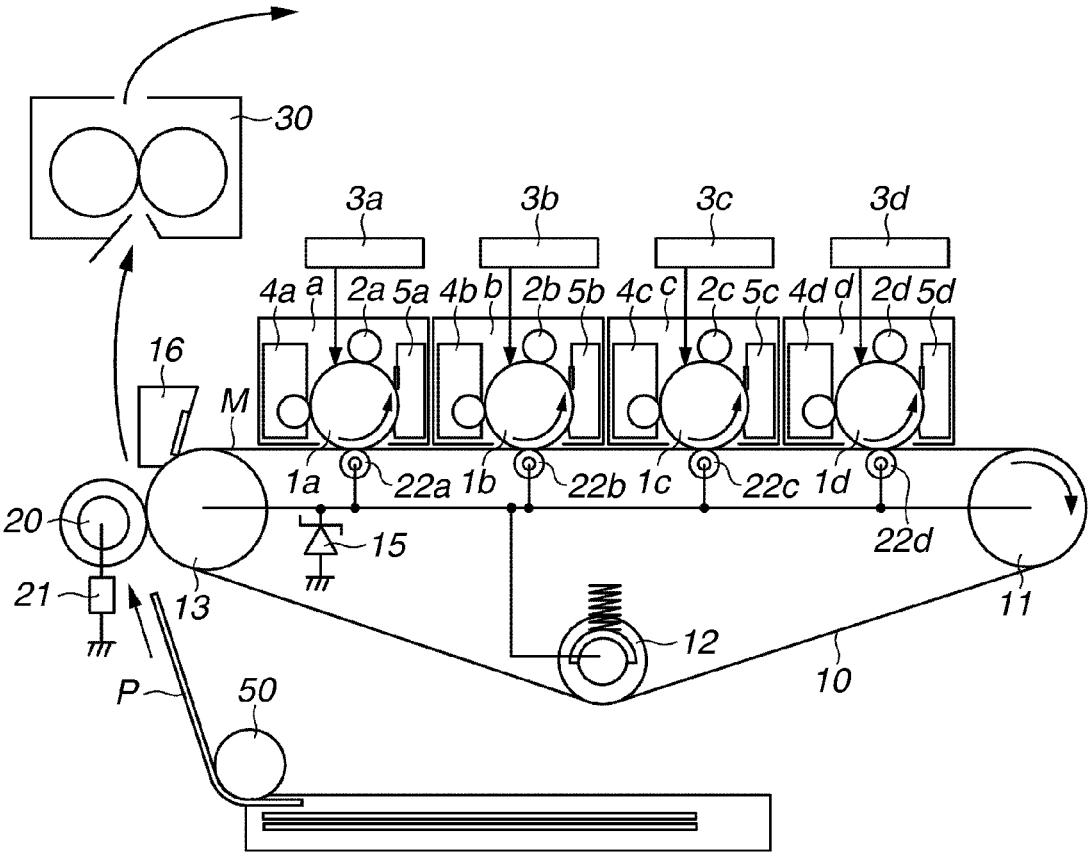
FIG. 15 illustrates another configuration of the image forming apparatus according to the second exemplary embodiment.

The above-mentioned configuration of the present exemplary embodiment, which is applicable to each primary transfer portion, includes the contact members 23*a*, 23*b*, 23*c*, and 23*d* positioned on the downstream side by a predetermined amount from the counter positions of respective photosensitive drums 1*a*, 1*b*, 1*c*, and 1*d*. However, another configuration is employable. For example, as illustrated in FIG. 15, each contact member 22*a*, 22*b*, 22*c*, and 22*d* can be disposed beneath a corresponding photosensitive drum 1*a*, 1*b*, 1*c*, and 1*d*. In this case, it is necessary to bring contact members 22*a*, 22*b*, 22*c*, and 22*d* into contact with respective photosensitive drums 1*a*, 1*b*, 1*c*, and 1*d* to secure primary transfer portions. Therefore, the contact member 22*a*, 22*b*, 22*c*, and 22*d* employable in this case is, for example, a roller with an elastic conductive layer coating the surface thereof.

Figure 16:
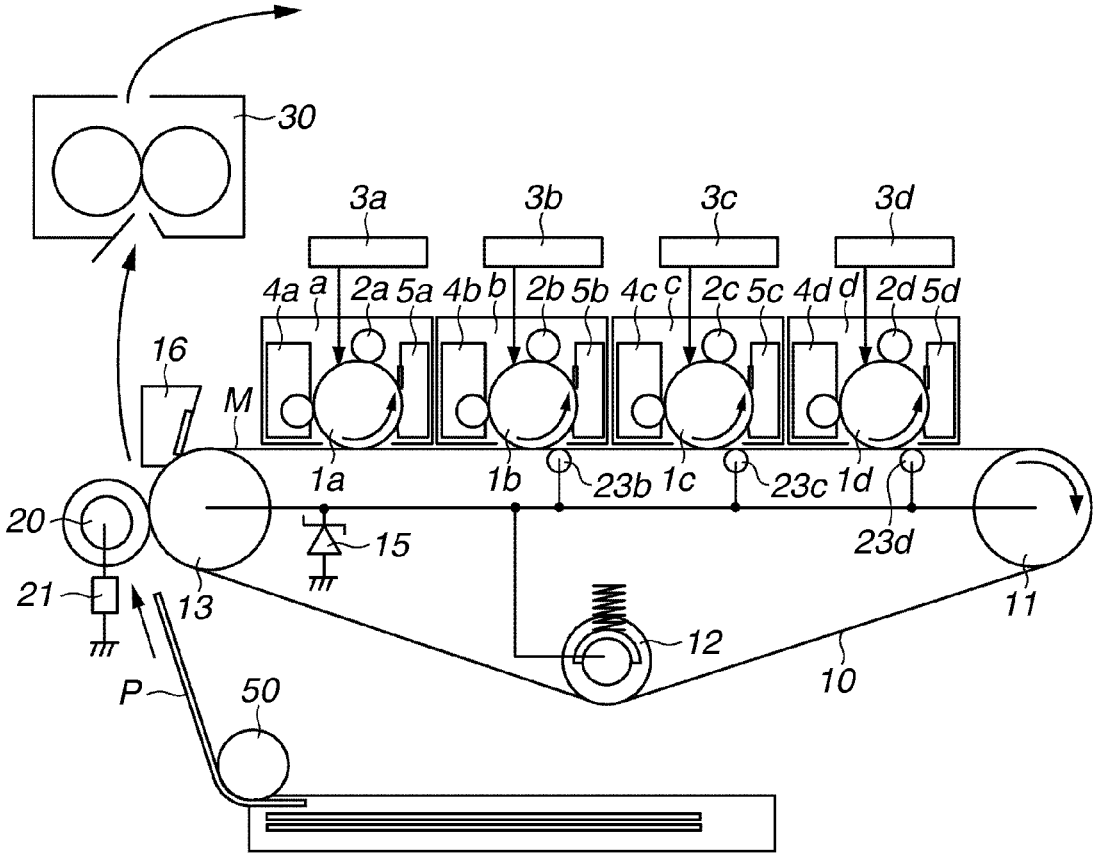
FIG. 16 illustrates another configuration of the image forming apparatus according to the second exemplary embodiment.

As another employable configuration, no metallic roller is provided near the photosensitive drum 1*a* as illustrated in FIG. 16, although three metallic rollers 23*b*, 23*c*, and 23*d* are disposed in an opposed relationship with and offset a predetermined amount from their corresponding photosensitive drums 1*b*, 1*c*, and 1*d*. The metallic rollers 23*b*, 23*c*, and 23*d* and the stretch rollers 11, 12, and 13 are connected to the earth via the Zener diode 15.

The image forming station "a" (yellow) is positioned near the secondary transfer roller 20, as described in the first exemplary embodiment. Therefore, compared to other image forming stations "b" to "d", it is easy for the image forming station "a" to maintain the primary transfer potential at a satisfactory level when current is supplied from the secondary transfer roller 20. In other words, the above-mentioned contact member (i.e., the metallic roller 23*a*) corresponding to the image forming station "a" (yellow) can be removed to reduce costs of the image forming apparatus.

Figure 17:
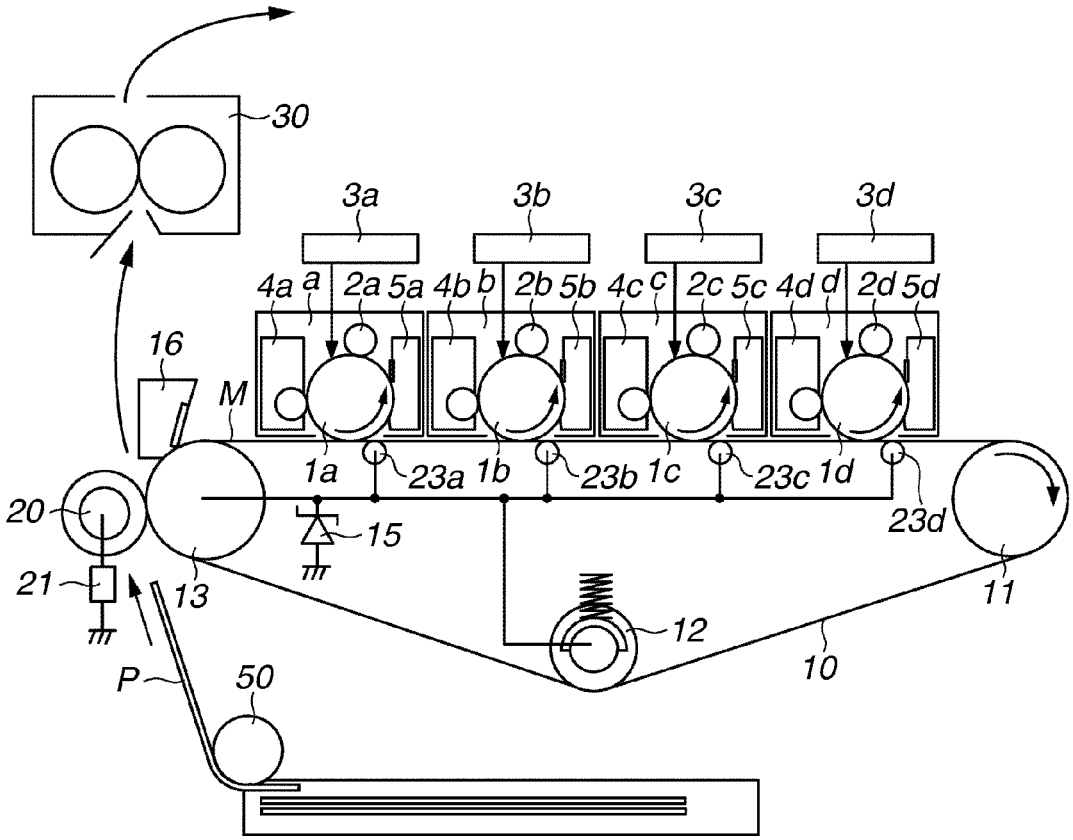
FIG. 17 illustrates another configuration of the image forming apparatus according to the second exemplary embodiment.

Further, as another employable configuration, the configuration illustrated in FIG. 3 can be modified in such a manner that the driving roller 11 (i.e., the roller that forms the primary transfer surface M) is isolated from the Zener diode 15 as illustrated in FIG. 17 (so that the driving roller 11 can be electrically insulated).

In this case, the metallic roller 23*d* (i.e. the roller positioned near the primary transfer portion) supplies compensating current in such a way as to maintain the primary transfer potential of the image forming station "d" positioned near the driving roller 11. As illustrated in FIG. 17, each metallic roller 23*a*, 23*b*, 23*c*, and 23*d* and the secondary transfer counter member 13 (i.e., the member opposed to the secondary transfer roller 20 via the intermediate transfer belt 10) are connected to the Zener diode 15 (i.e., the voltage maintenance element). Therefore, the configuration illustrated in FIG. 17 can bring effects similar to those of the configuration illustrated in FIG. 13. Further, if the electric conductivity of the intermediate transfer belt 10 is lower, it is useful to connect only the secondary transfer counter roller 13 and the metallic roller 23*d* to the Zener diode 15.

Further, the contact member can be disposed between the secondary transfer counter roller 13 and the driving roller 11 that cooperatively form the primary transfer surface M of the intermediate transfer belt 10 in such a manner that the contact member contacts the outer circumferential surface of the intermediate transfer belt 10. For example, as a method for bringing the contact member into contact with the outer circumferential surface of the intermediate transfer belt 10, the contact member can be disposed at an end of the intermediate transfer belt 10 in the longitudinal direction.

Similar to the first exemplary embodiment, the voltage maintenance element used in the present exemplary embodiment to stabilize the intermediate transfer belt potential is the Zener diode 15 (i.e., the constant-voltage element). However, another constant-voltage element (e.g., a varistor) that can bring similar effects is usable. Further, a resistance element is usable if it can maintain the primary transfer potential at a predetermined potential or more. For example, it is useful to use a 100 M Ω resistance element. However, in a case where the voltage maintenance element is a resistance element, the electric potential varies depending on the amount of current flowing through the resistance element. Therefore, managing the electric potential becomes difficult compared to the above-mentioned constant-voltage element.

Further, a plurality of voltage maintenance elements are usable. Using a common voltage maintenance element (see the voltage maintenance element 15 described in the present exemplary embodiment) is useful in that all connected members (e.g., the driving roller 11, the secondary transfer counter roller 13, and the metallic roller 23*d*) can be maintained at the same potential.

According to the configurations described in the first and second exemplary embodiments, the Zener diode 15 employed as the voltage maintenance element maintains the electric potential of each connected member (i.e., the stretch members and the contact members) at a positive level. In a third exemplary embodiment, the stretch members and the contact members are connected to an anode side of the Zener diode so that the electric potential of each member connected to the Zener diode can be maintained at a negative level.

Figure 18:
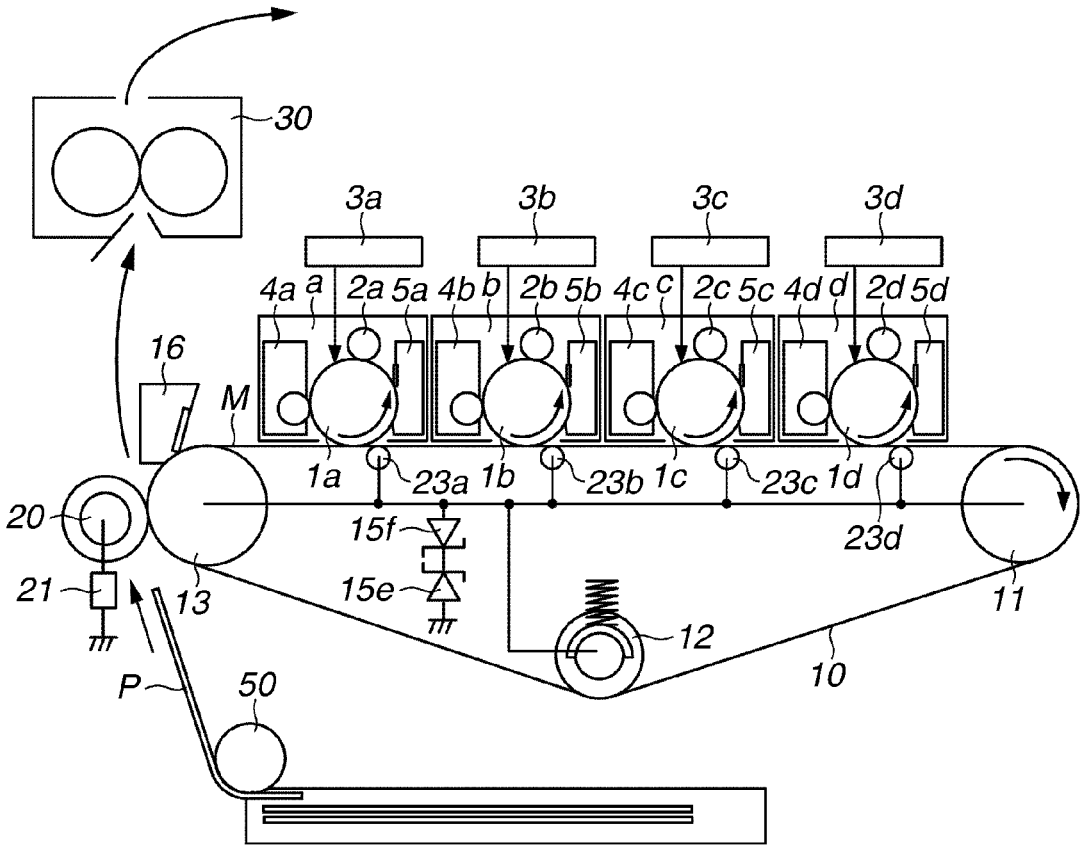
FIG. 18 schematically illustrates an image forming apparatus according to a third exemplary embodiment.

FIG. 18 schematically illustrates an example of the image forming apparatus according to the present exemplary embodiment. The image forming apparatus illustrated in FIG. 18 is similar to the image forming apparatus described in the second exemplary embodiment, except that the Zener diode 15 (i.e., the voltage maintenance element) illustrated in FIG. 13 is replaced by a plurality of the Zener diodes 15*f* and 15*e*. Therefore, the same reference numbers are allocated to similar members.

In the present exemplary embodiment, an anode side of the Zener diode 15*e* (i.e., the voltage maintenance element 15 having the Zener voltage 200 [V]) is connected to the earth. Further, a cathode side of the Zener diode 15*e* is connected to a cathode side of the Zener diode 15*f* and an anode side of the Zener diode 15*f* is connected to the secondary transfer counter roller 13 and the driving roller 11. The Zener diode 15*f* has a Zener voltage 400 [V]. When a first Zener diode refers to the Zener diode 15*e* and a second Zener diode refers to the Zener diode 15*f*, the first and second Zener diodes are reversely connected. Further, when a first predetermined potential refers to the Zener voltage 200 [V] of the Zener diode 15*e* and a second predetermined potential refers to the Zener voltage 400 [V] of the Zener diode 15*f*, the first and second predetermined potentials are mutually different in absolute value.

In the present exemplary embodiment, the electric potential of the intermediate transfer belt 10 is maintained at a negative value, as described below. For example, it is necessary to maintain the intermediate transfer belt 10 at a negative potential in a case where the intermediate transfer belt 10 is cleaned by causing negative toner particles adhering to the intermediate transfer belt 10 to move to respective photosensitive drums 1*a* to 1*d*.

When the transfer power source 21 applies a negative voltage (−1000 [V]) to the secondary transfer roller 20, current flows from the grounded Zener diode 15*e* to the secondary transfer roller 20 via the intermediate transfer belt 10 and the secondary transfer counter roller 13. At this moment, the opposite polarity voltage is applied to the Zener diode 15*f* because the current flows from the cathode side to the anode side. The anode side of the Zener diode 15*f* can be maintained at the Zener voltage because the cathode side of the Zener diode 15*f* is grounded via the Zener diode 15*e*. Accordingly, the electric potential of the secondary transfer counter roller 13, the driving roller 11, and the metallic rollers 23*a*, 23*b*, 23*c*, and 23*d* can be maintained at −400 [V] because these members are connected to the anode side of the Zener diode 15*f*.

Regardless of polarity of the applied voltage, if the electric potential of the intermediate transfer belt 10 can be maintained at substantially the same level at upstream and downstream sides of the primary transfer surface, it is feasible to prevent the electric potential of the intermediate transfer belt 10 from varying along the entire primary transfer surface and maintain the electric potential of each primary transfer portion at the desired potential (−400 [V]). Maintaining the electric potential of each primary transfer portion at a desired negative potential ensures that the negative toner particles adhering to the intermediate transfer belt 10 can move to respective photosensitive drums 1*a* to 1*d*.

The image forming apparatus according to the present exemplary embodiment employs a plurality of Zener diodes, each serving as the voltage maintenance element, which are connected in series. The reason for the above-mentioned configuration is described below.

Figure 19:
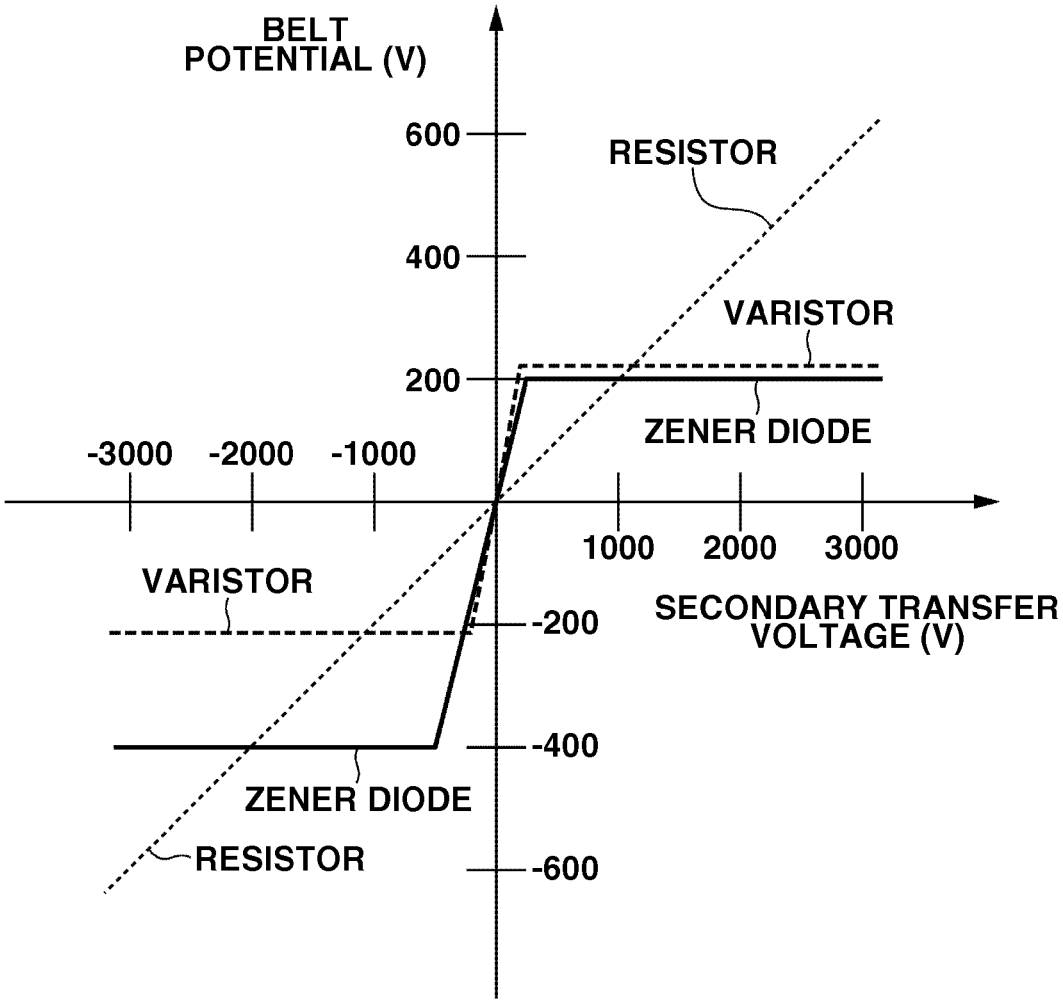
FIG. 19 is a graph illustrating a relationship between secondary transfer voltage and intermediate transfer belt potential.

FIG. 19 illustrates a relationship between the secondary transfer voltage and the intermediate transfer belt potential. In FIG. 19, the abscissa refers to the secondary transfer voltage [V] and the ordinate refers to the belt voltage [V]. Examples of the voltage maintenance element employed to evaluate the relationship between the secondary transfer voltage and the belt potential are a resistance element having a large resistance value (e.g., a 100 [MΩ] resistance element), a varistor (having a 200 [V] varistor voltage), and a Zener diode.

As understood from FIG. 19, in a case where the varistor is employed as the voltage maintenance element, the absolute value of the belt potential is maintained at substantially the same level (i.e., the varistor voltage) regardless of polarity of the secondary transfer voltage. More specifically, if the voltage applied to both ends of the varistor exceeds the varistor voltage, current suddenly flows through the varistor and both ends of the varistor are maintained at the varistor voltage. In a case where the resistance element is employed as the voltage maintenance element, the belt potential proportionately becomes greater as the secondary transfer voltage increases.

As understood from FIG. 19, if the varistor is employed as the voltage maintenance element, the absolute value of the belt potential is uniquely fixed at the predetermined level (varistor voltage) regardless of polarity of the secondary transfer voltage. Therefore, independently optimizing the belt potential value for each of the positive polarity and the negative polarity is difficult. For example, if it is required to set the electric potential of each primary transfer portion to 200 [V] for the primary transfer, or if it is required to maintain the electric potential of each primary transfer portion at −400 [V] to cause negative toner particles to move from the intermediate transfer belt 10 to each photosensitive drum 1*a*, 1*b*, 1*c*, and 1*d*, such requests cannot be satisfied.

If the resistance element with one end grounded is employed as the voltage maintenance element, the positive (or negative) belt potential increases (or decreases) in proportion to the secondary transfer voltage. An appropriate value of the secondary transfer voltage greatly changes depending on various conditions (e.g., recording material and environment). On the other hand, an appropriate value of the electric potential for the primary transfer at the primary transfer portion does not change so much depending on the above-mentioned conditions. Therefore, appropriately setting both the secondary transfer voltage and the primary transfer potential is generally difficult.

To the contrary, if the Zener diode is employed as the voltage maintenance element, the belt potential can be maintained at a predetermined Zener voltage for each of the positive polarity and the negative polarity, while suppressing the electric potential of the intermediate transfer belt from varying along the entire primary transfer surface. Accordingly, in a case where the image forming apparatus is configured to form the electric potential of each primary transfer portion by causing current to flow from the current supply member to the intermediate transfer belt, it is feasible to prevent the electric potential of each primary transfer portion from varying in response to the positive or negative voltage applied by the power source and it is feasible to independently form the desired primary transfer potential for each primary transfer portion.

Figure 20:
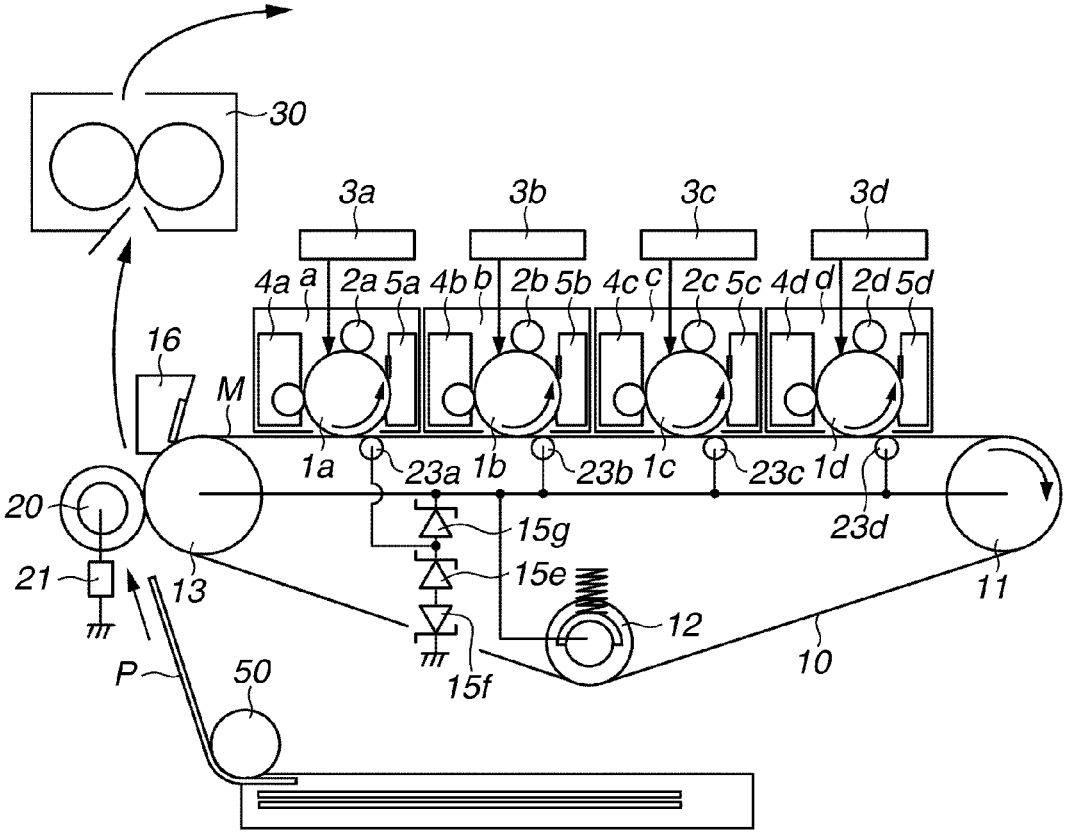
FIG. 20 illustrates another configuration of the image forming apparatus according to the third exemplary embodiment.

Further, the voltage maintenance element used in the present exemplary embodiment is the only one Zener diode 15*e* that outputs the positive Zener voltage. However, another configuration is employable. For example, the voltage maintenance element illustrated in FIG. 20 is a combination of three Zener diodes 15*e*, 15*f*, and 15*g* that are connected in series. More specifically, the cathode side of the Zener diode 15*f* is connected to the earth. The anode side of the Zener diode 15*f* is connected to the anode side of the Zener diode 15*e*. The cathode side of the Zener diode 15*e* is connected to the metallic roller 23*a* and to an anode side of a Zener diode 15*g*. Further, a cathode side of the Zener diode 15*g* is connected to the secondary transfer counter roller 13, the metallic rollers 23*b*, 23*c*, and 23*d*, and the driving roller 11.

As a set of Zener diodes that cooperatively serve as the constant-voltage element, the Zener diode 15*e* has a 200 [V] Zener voltage, the Zener diode 15*f* has a 400 [V] Zener voltage, and the Zener diode 15*g* has a 50 [V] Zener voltage.

When the transfer power source 21 applies a positive voltage to the secondary transfer roller 20, constant current flows from the secondary transfer roller 20 to the Zener diode 15*g* and the Zener diode 15*e* via the intermediate transfer belt 10 and the secondary transfer counter roller 13. In this case, respective Zener diodes can maintain their Zener voltages. The metallic roller 23*a* connected to the cathode side of the Zener diode 15*e* can be maintained at 200 [V]. Other metallic rollers 23*b*, 23*c*, and 23*d* are connected to the cathode side of the Zener diode 15*g*. Therefore, it is feasible to maintain a 250 [V] voltage, which is a sum of the Zener voltage of the Zener diode 15*e* and the Zener voltage of the Zener diode 15*g*.

Further, when the negative voltage is applied to the secondary transfer roller 20, respective metallic rollers 23*a*, 23*b*, 23*c*, and 23*d* can be maintained at −400 [V]. For example, as another employable configuration, it is useful to set the primary transfer potentials of the second, third, and fourth image forming stations "b" to "d" to be higher than that of the first image forming station "a" to improve transfer characteristics of the second to fourth image forming stations "b" to "d".

Further, it is useful to change the number of Zener diodes to be connected and change the primary transfer potential for each of the second, third, and fourth image forming stations "b" to "d". Further, to change the primary transfer potential of each image forming station "a" to "d" when the negative voltage is applied, it is useful to increase the number of Zener diodes whose anode side is connected to the earth side.

The current supply member used in the first exemplary embodiment to supply current to the intermediate transfer belt 10 is the secondary transfer roller 20. However, in a fourth exemplary embodiment, the current supply member is not limited to the secondary transfer roller 20. An image forming apparatus according to the fourth exemplary embodiment includes an additional conductive member that can supply current to the intermediate transfer belt 10.

More specifically, a conductive member usable in the present exemplary embodiment is a pair of charging members 18 and 17 that can clean toner particles remaining on the intermediate transfer belt 10. The rest of the configuration of the image forming apparatus according to the fourth exemplary embodiment is similar to that of the image forming apparatus described in the first exemplary embodiment. Therefore, the same reference numbers are allocated to similar members.

Figure 21:
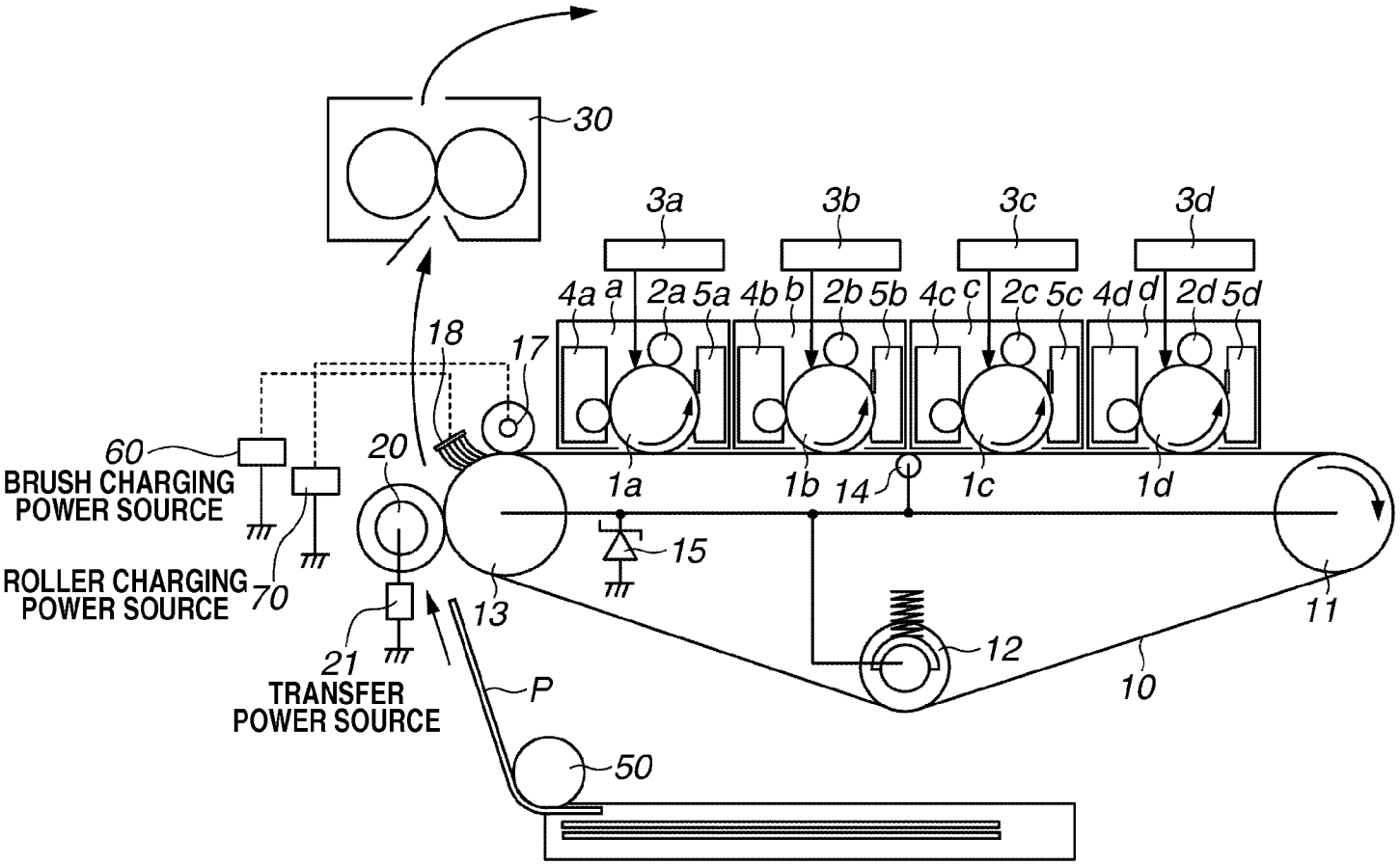
FIG. 21 schematically illustrates an image forming apparatus according to a fourth exemplary embodiment.

FIG. 21 is a schematic sectional view illustrating the image forming apparatus according to the present exemplary embodiment. The image forming apparatus according to the present exemplary embodiment is different from the image forming apparatus according to the first exemplary embodiment in that the cleaning unit 16 is replaced by the conductive brush member 18 and the charging roller member 17 (i.e., the charging members) that collect toner particles remaining on the intermediate transfer belt 10.

The secondarily transferred toner particles remaining on the intermediate transfer belt 10 are charged by the conductive brush member 18 and the charging roller member 17 (i.e., the charging members). The conductive brush member 18 is constituted by electrically conductive fibers 18*a*. A brush charging power source 60 applies a predetermined voltage to the conductive brush member 18 to charge secondary transfer residue toner particles. In the present exemplary embodiment, the normal charging polarity of toner particles accommodated in the development unit is negative polarity. Therefore, the brush charging power source 60 (i.e., a first charging power source) applies a positive voltage to the conductive brush member 18 so that the remaining toner particles have positive polarity.

The conductive roller 17 is an elastic roller that includes, as a main component, urethane rubber having a $1\times10^9$ Ω·cm volume resistivity rate. The conductive roller 17 is opposed to the secondary transfer counter roller 13 via the intermediate transfer belt 10, while a 9.8 N total pressure is given by a spring (not illustrated). The conductive roller 17 is driven by the intermediate transfer belt 10 in such a manner that the conductive roller 17 rotates around its rotational axis at a peripheral speed identical to the traveling speed of the intermediate transfer belt 10. A roller charging power source 70 (i.e., a second charging power source) applies a+1500 [V] voltage to the conductive roller 17 so that the secondary transfer residue toner particles have positive polarity.

The conductive brush member 18 is constituted by an electrically conductive fiber. The brush charging power source 60 applies a predetermined voltage to the conductive brush member 18 to charge the secondary transfer residue toner particles. The conductive fibers 18*a* constituting the conductive brush member 18 include nylon components and have a 100 kF/inch$^2$ density. The conductive fiber 18*a* includes carbon conducting agent additives. The resistance value per unit length of the conductive fiber 18*a* is $1\times10^8$ Ω/cm. The fineness of the conductive fiber 18*a* is 300 T/60 F.

A method for cleaning the intermediate transfer belt 10, which is applicable to the above-mentioned configuration, is described in detail below with reference to FIG. 22.

In the present exemplary embodiment, toner particles have negative polarity when they are charged by the development units 4*a* to 4*d*, as mentioned above. The toner particles are developed by respective photosensitive drums 1*a* to 1*d* and primarily transferred to the intermediate transfer belt 10 at respective primary transfer portions. Subsequently, in a state where the transfer power source 21 applies a positive voltage to the secondary transfer roller 20, the toner particles are secondarily transferred to the recording material P (e.g., a paper) to form an image thereon.

Figure 22:
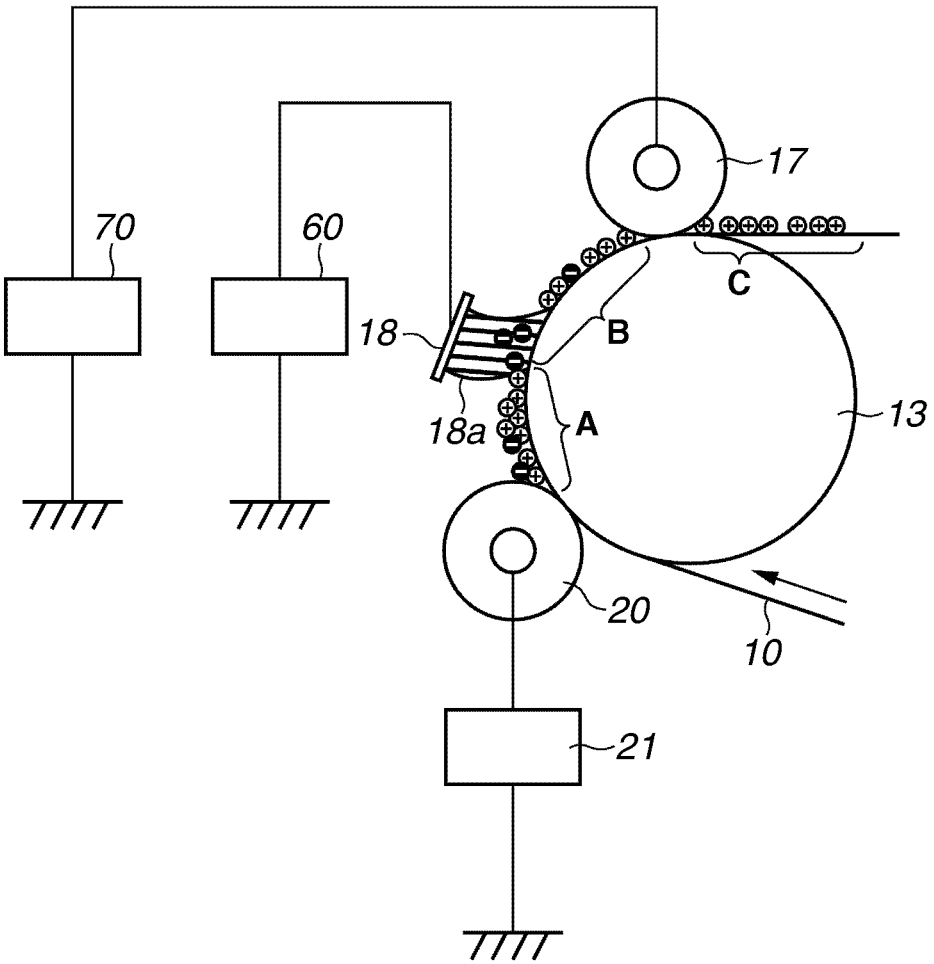
FIG. 22 illustrates a cleaning configuration according to the fourth exemplary embodiment.

As illustrated in FIG. 22, the toner particles remaining on the intermediate transfer belt 10 without being secondarily transferred to the recording material P tend to have positive polarity due to the influence of the positive voltage applied to the secondary transfer roller 20. As a result, the secondary transfer residue toner particles are a mixture of positive and negative toner particles. Further, due to the influence of a surface undulation on the recording material P, the secondary transfer residue toner particles locally form a plurality of layers on the intermediate transfer belt 10 (see a region "A" in FIG. 22).

The conductive brush member 18 is positioned on the upstream side of the conductive roller 17 in the moving direction of the intermediate transfer belt 10. The conductive brush member 18 is stationarily disposed relative to the moving intermediate transfer belt 10 in such a manner that a distal portion of the conductive fibers 18*a* contacts the intermediate transfer belt 10. The conductive brush member 18 is supported by an apparatus body member without causing any rotation while the intermediate transfer belt 10 is moving. Therefore, when the secondary transfer residue toner particles pass through the charging portion formed by the conductive brush member 18 and the intermediate transfer belt 10, the conductive brush member 18 mechanically scrapes the multilayered toner particles on the intermediate transfer belt 10 into a single layer using the peripheral speed difference (see a region "B" in FIG. 22).

Further, the polarity of the secondary transfer residue toner particles is changed to positive polarity (opposed to the toner polarity in the development process) when the toner particles pass through the charging portion, because the brush charging power source 60 performs constant-current control for applying the positive voltage to the conductive brush member 18. Toner particles continuously maintaining negative polarity are collected by the conductive brush member 18.

Subsequently, the secondary transfer residue toner particles having passed through the conductive brush member 18 move in the moving direction of the intermediate transfer belt 10 and reach the conductive roller member 17. The roller charging power source 70 applies the positive voltage (i.e., +1500 V in the present exemplary embodiment) to the conductive roller member 17. Therefore, after having passed through the conductive brush member 18, the secondary transfer residue toner particles are further charged to enhance the positive polarity when they pass through the conductive roller member 17 (see a region "C" in FIG. 22).

The adequately charged toner particles remaining on the intermediate transfer belt 10, then, move to the negatively charged photosensitive drum 1*a* at the primary transfer portion. Then, the toner particles transferred to the photosensitive drum 1*a* are collected by the cleaning unit 5*a* disposed near the photosensitive drum 1*a*.

The timing when the positively charged toner particles move from the intermediate transfer belt 10 to the photosensitive drum 1*a* and the timing when a toner image is primarily transferred from the photosensitive drum 1*a* to the intermediate transfer belt 10 can be the same or independent from each other.

In the present exemplary embodiment, the conductive roller member 17 is positioned on the downstream side of the conductive brush member 18 in the moving direction of the intermediate transfer belt 10. This arrangement is effective to unify the charging amount of toner particles when they have passed through the charging portion. Therefore, even when the conductive roller member 17 is not provided, using only the conductive brush member 18 to charge the secondary transfer residue toner particles is feasible if the charging amount of toner particles is within a predetermined range.

As mentioned above, the image forming apparatus according to the present exemplary embodiment includes the conductive brush member 18 and the charging roller 17 (i.e., the charging members) in addition to the secondary transfer roller 20 (i.e., the current supply member). The reason for employing the above-mentioned configuration is described below.

The secondary transfer roller 20 described in the first exemplary embodiment has the following roles. The first role is supplying secondary transfer current by an amount sufficient to attain satisfactory secondary transfer characteristics. The second role is supplying primary transfer current to each photosensitive drum 1*a*, 1*b*, 1*c*, and 1*d* by an amount sufficient to maintain the electric potential of the intermediate transfer belt 10 at each primary transfer portion. Accordingly, the secondary transfer roller 20 described in the first exemplary embodiment is required to operate as the current supply member that can supply a desired amount of secondary transfer current and a desired amount of primary transfer current.

A relationship between the desired amount of secondary transfer current and the desired amount of primary transfer current is described below. It is useful to set the secondary transfer current to be a current value that can optimize the transfer efficiency at the secondary transfer portion where the toner image is transferred to the recording material P. A secondary transfer current transition in the present exemplary embodiment is illustrated in FIG. 23.

Figure 23:
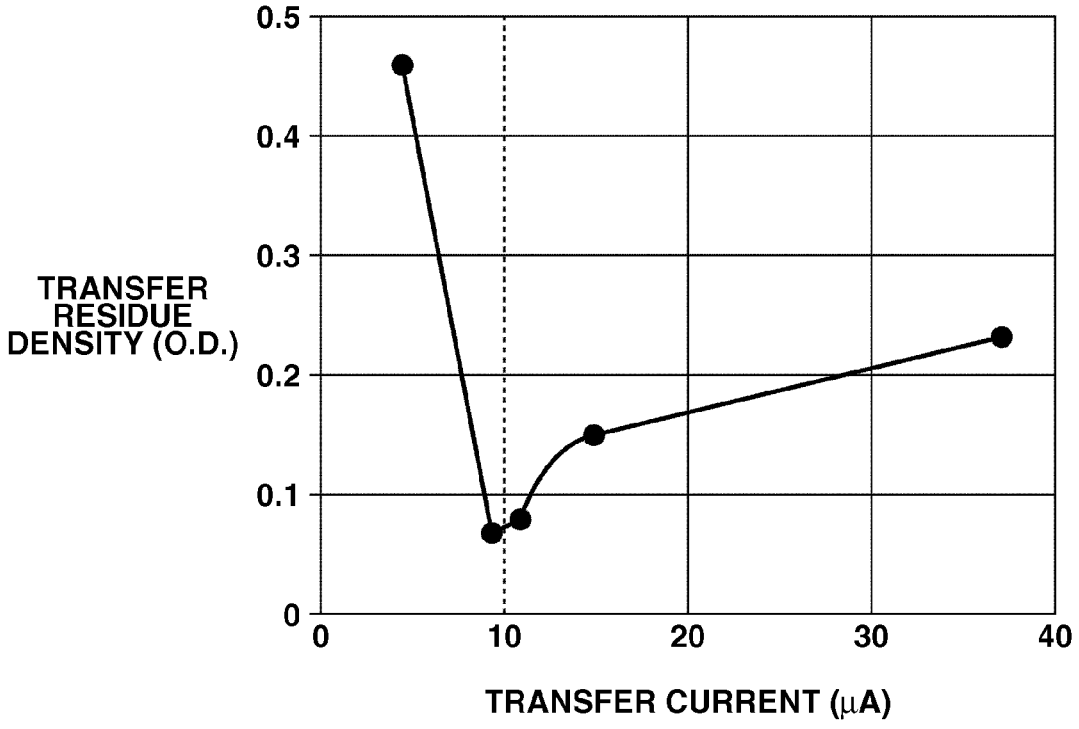
FIG. 23 is a graph illustrating a relationship between transfer current and secondary transfer efficiency.

FIG. 23 is a graph illustrating a relationship between the transfer current and the secondary transfer efficiency, in which the ordinate refers to the transfer efficiency that is a measurement result of secondary transfer residue density measured with a Macbeth Transmission Reflection Densitometer (provided by GretagMacbeth). It is understood that the transfer efficiency becomes higher when the ordinate value decrease. The recording material P used in the measurement is a brand-new paper named as Business4200 (gramma: 75 $g/m^2$), which is provided by Xerox Corporation. From the result illustrated in FIG. 23, it is understood that the optimum current amount for the secondary transfer in the present exemplary embodiment is 10 μA because the transfer efficiency can be maximized.

Figure 24:
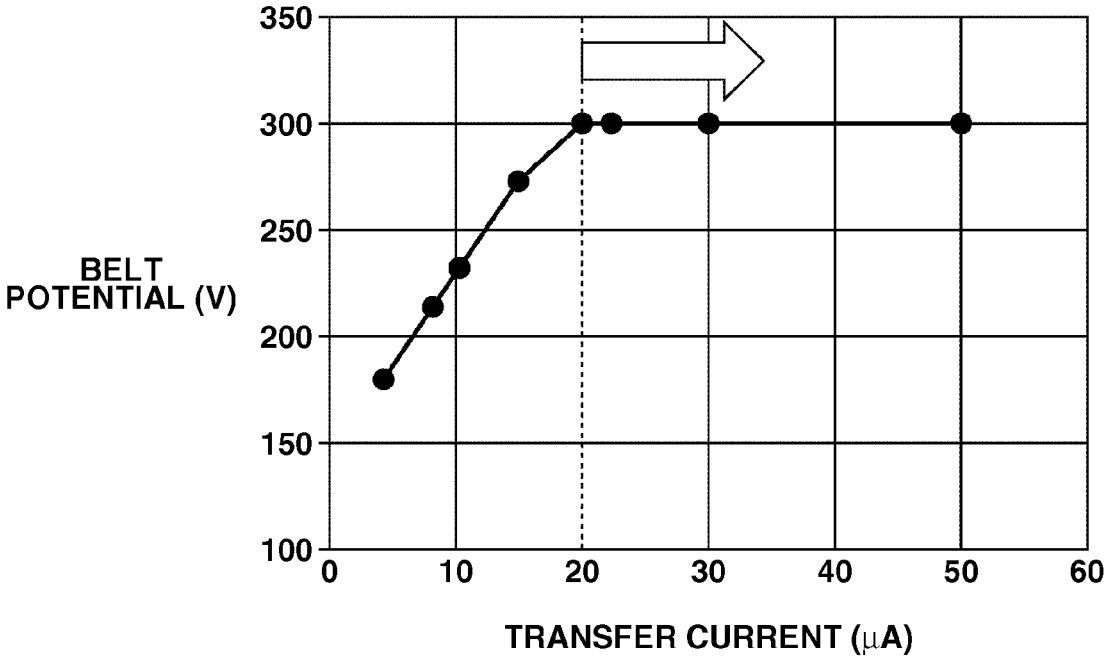
FIG. 24 is a graph illustrating a relationship between transfer current and belt potential.

Next, a desired amount of current for the primary transfer to stabilize the primary transfer potential is described below. FIG. 24 illustrates a measurement result of the electric potential of the intermediate transfer belt 10 obtained when current is supplied from the secondary transfer roller 20, in a state where the voltage maintenance element (Zener diode) 15 is connected to the secondary transfer counter roller 13, the driving roller 11, and the metallic roller 14. In FIG. 24, the ordinate refers to the electric potential of an area where each member connected to the voltage maintenance element contacts the intermediate transfer belt 10 and the abscissa refers to the current value.

In FIG. 24, a dotted line indicates a current value that can realize the electric potential satisfactory for the primary transfer. If the current value exceeds the required level indicated by the dotted line, a sufficient electric potential can be formed at each primary transfer portion. From the result illustrated in FIG. 24, it is understood that the secondary transfer current required to maintain the electric potential for the primary transfer in the present exemplary embodiment is 20 μA or more. If it is presumed that the current supplied from the secondary transfer roller 20 uniformly flows into the primary transfer portion of each image forming station "a" to "d" via the intermediate transfer belt 10, the current distributed to the photosensitive drum 1*a*, 1*b*, 1*c*, and 1*d* of each image forming station "a" to "d" is 5 μA. Excessive current flows into the Zener diode 15.

Accordingly, when TA represents the satisfactory current amount for the primary transfer and TB represents the current amount supplied to the intermediate transfer belt 10, a desired primary transfer performance can be realized when TB is equal to or greater than TA.

If the device that supplies the current amount TB is limited to the secondary transfer roller 20, the required current supply amount is 20 μA or more (which is greater than the current amount (10 μA) that optimizes the secondary transfer performance). Hence, as described in the first exemplary embodiment, if only the secondary transfer roller 20 supplies current, it is required to increase the current supply amount within a range acceptable for the secondary transfer performance in such a way as to obtain the desired primary transfer performance.

In view of the foregoing, the image forming apparatus according to the present exemplary embodiment employs the charging members 18 and 17 as the current supply member. Thus, the current amount supplied from the secondary transfer roller 20 can be optimized for the desired secondary transfer current amount and satisfactory primary transfer characteristics can be secured.

More specifically, the controller 100 controls the brush charging power source 60 and the roller charging power source 70 to supply current to the intermediate transfer belt 10 via the conductive brush member 18 and the conductive roller 17.

As mentioned above, the required current amount for the primary transfer is 20 μA. Accordingly, a sufficient electric potential for the primary transfer can be maintained if the total current of the conductive brush member 18, the conductive roller 17, and the secondary transfer roller 20 is 20 μA or more. Therefore, even when the current supplied from the secondary transfer roller 20 is 10 μA, if the current supplied from the charging members 18 and 17 is 10 μA or more, the total current becomes 20 μA or more. Therefore, both the secondary transfer and the primary transfer can be appropriately performed.

Figure 25:
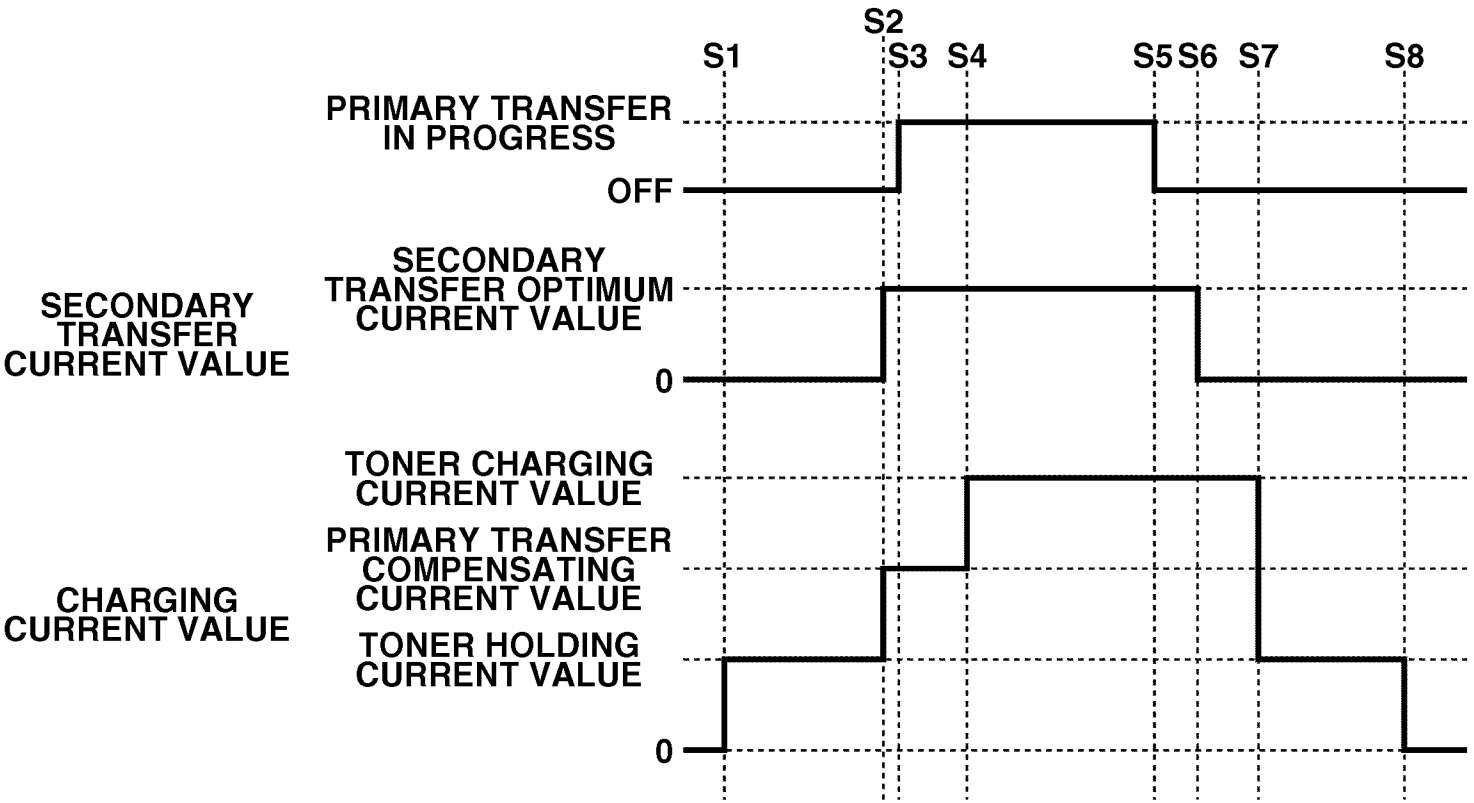
FIG. 25 is a timing chart illustrating transfer processes in an image forming operation according to the fourth exemplary embodiment.

Transfer process voltage application timing according to the present exemplary embodiment is described below with reference to FIG. 25. FIG. 25 is a timing chart illustrating a sequential image forming operation, which includes performing primary and secondary transfer processing after starting the operation and stopping a main motor after outputting two recording materials P.

If the main motor starts operating in response to an instruction of the image forming operation, then at timing S1, the controller 100 controls each power source to supply toner holding current to the conductive brush member 18 and the conductive roller 17 to prevent toner particles from falling off the conductive brush member 18 and the conductive roller 17. The charging current value (i.e., the toner holding current value) at this moment, which is equal to the total current flowing through the conductive brush member 18 and the conductive roller 17, is set as 5 μA. Hereinafter, the current flowing from the charging members (i.e., the conductive brush member 18 and the conductive roller 17) to the intermediate transfer belt 10 is referred to as the charging current.

Before starting the primary transfer processing for image formation, the controller 100 causes the secondary transfer roller 20 to start supplying current to the intermediate transfer belt 10 (the current supplied from the secondary transfer roller 20 in this case is hereinafter referred to as "secondary transfer current"). At the same time (at timing S2), the controller 100 increases the charging current to cause the conductive brush member 18 and the conductive roller 17 to supply current (i.e., primary transfer compensating current) to the intermediate transfer belt 10. In the present exemplary embodiment, the secondary transfer current value is 10 μA and the primary transfer compensating current value is 15 μA, although the current setting values are not limited to the above-mentioned examples. For example, when the transfer processing being currently performed is only the primary transfer processing, it is useful that only the secondary transfer roller 20 supplies the required current.

At timing S3, the controller 100 starts the primary transfer processing in a state where the predetermined current is supplied to the intermediate transfer belt 10, so that toner images can be successively transferred from respective photosensitive drums 1*a*, 1*b*, 1*c*, and 1*d* to the intermediate transfer belt 10. If the toner images having been primarily transferred to the intermediate transfer belt 10 reach the secondary transfer portion, the controller 100 changes the charging current to a current value desired for the secondary transfer processing. More specifically, at timing S4, the controller 100 increases the charging current to a toner charging current value (i.e., 20 μA) while performing constant-current control with the secondary transfer current value fixed at 10 μA. In the present exemplary embodiment, the secondary transfer current has the value (10 μA) having been optimized for the secondary transfer processing. Therefore, the optimum current can be continuously supplied when the image forming apparatus performs the primary transfer processing and the secondary transfer processing.

Subsequently, at timing S5, the image forming apparatus terminates the primary transfer processing while continuing the secondary transfer processing. If the image forming apparatus terminates the secondary transfer processing, then at timing S6, the controller 100 stops supplying the secondary transfer current.

Then, the controller 100 maintains the total current flowing through the conductive brush member 18 and the conductive roller 17 at 20 μA to charge the toner particles until the rear end of the secondary transfer residue toner particles (i.e., the toner particles generated in the secondary transfer processing) pass through the conductive brush member 18 and the conductive roller 17 (see timing S7). After the timing S7, the controller 100 can change the charging current to the toner holding current value. If the cleaning of the intermediate transfer belt 10 terminates, then at timing S8, the controller 100 stops applying the voltage to the conductive brush member 18 and the conductive roller 17 and terminates the sequential image forming operation.

As mentioned above, at the secondary transfer execution timing, the current supplied from the secondary transfer roller 20 has a current amount (10 μA) optimum for the secondary transfer processing. The charging members 18 and 17 supply additional charging current to satisfy the current amount required for the primary transfer processing. Accordingly, the image forming apparatus according to the present exemplary embodiment can adequately perform the primary transfer processing while improving the secondary transfer performance.

Although the current supply member used in the present exemplary embodiment is the charging members 18 and 17, another member is also usable. For example, the cleaning blade of the cleaning unit 16 described in the first exemplary embodiment is employable as a conductive member. More specifically, it is useful to provide an arrangement for applying a voltage to the cleaning blade so that the cleaning blade can be used as the conductive member.

The above-mentioned charging current is not limited to the total current flowing through the conductive brush member 18 and the conductive roller 17. For example, if the conductive roller 17 is omitted, only the conductive brush member 18 supplies the charging current.

Figure 26:
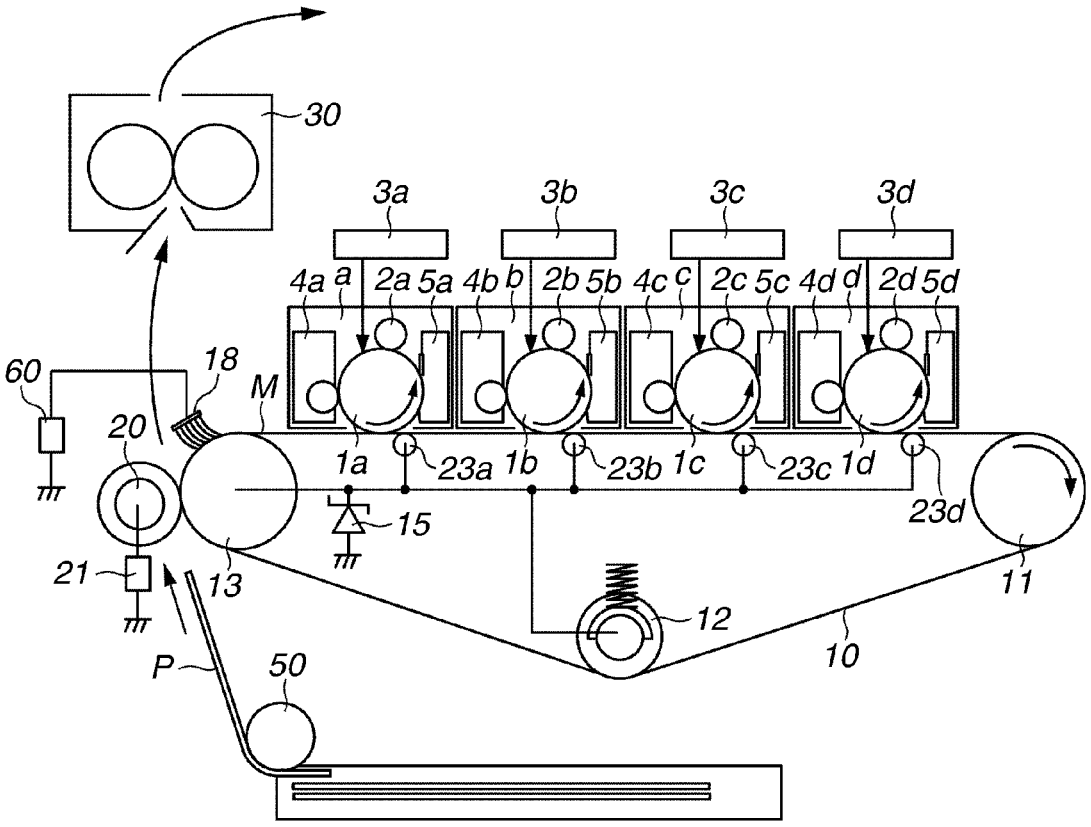
FIG. 26 illustrates another configuration of the image forming apparatus according to the fourth exemplary embodiment.

Further, the above-mentioned arrangement is applicable to the configuration illustrated in the second exemplary embodiment, in which a member to be opposed to each primary transfer portion is provided. For example, as illustrated in FIG. 26, similar effects can be obtained even when the cleaning unit 16 described in the second exemplary embodiment with reference to FIG. 17 is replaced by the conductive brush member 18.

Further, when the intermediate transfer belt 10 has a lower resistance value in the circumferential direction, the charging current can increase the amount of current to be supplied to the intermediate transfer belt 10 and can increase the current flowing into the primary transfer portion. If increasing the amount of current to be supplied to each primary transfer portion without increasing the secondary transfer current amount is feasible, the effect of preventing the electric potential of each primary transfer portion from varying in the image forming operation can be obtained.

Figure 27:
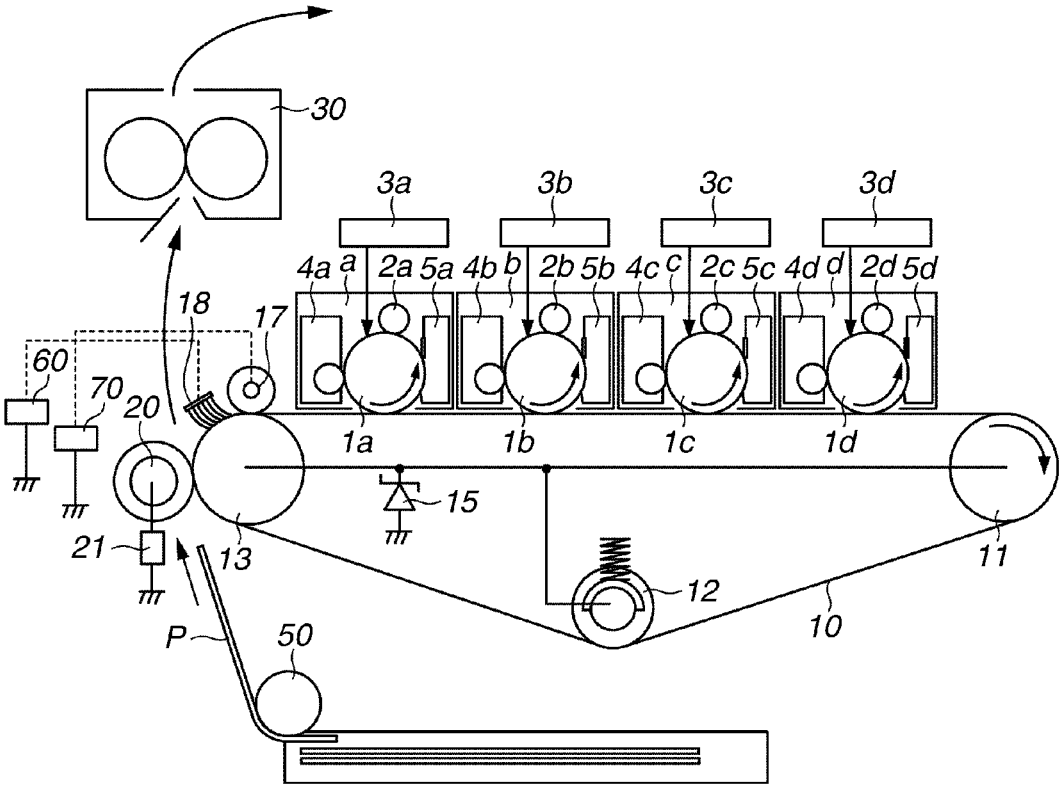
FIG. 27 illustrates a modified image forming apparatus according to the fourth exemplary embodiment.

FIG. 27 schematically illustrates another image forming apparatus according to the present exemplary embodiment, which includes a plurality of image carriers 1*a*, 1*b*, 1*c*, and 1*d* each carrying a toner image, an electrically conductive endlessly movable intermediate transfer belt 10 to which toner images can be primarily transferred from the plurality of image carriers, and a plurality of stretch members 11, 12, and 13 that cooperatively stretch the intermediate transfer belt 10. The image forming apparatus illustrated in FIG. 27 further includes a secondary transfer member 20 that forms a secondary transfer portion together with the intermediate transfer belt 10 to secondarily transfer the toner images from the intermediate transfer belt 10 to a recording material P, a transfer power source 21 that applies a sufficient voltage to the secondary transfer member 20, a voltage maintenance element 15 connected to the plurality of stretch members 11, 12, and 13, and an electrically conductive member (not shown) that contacts the intermediate transfer belt 10 to supply current to the intermediate transfer belt 10.

Figure 28:
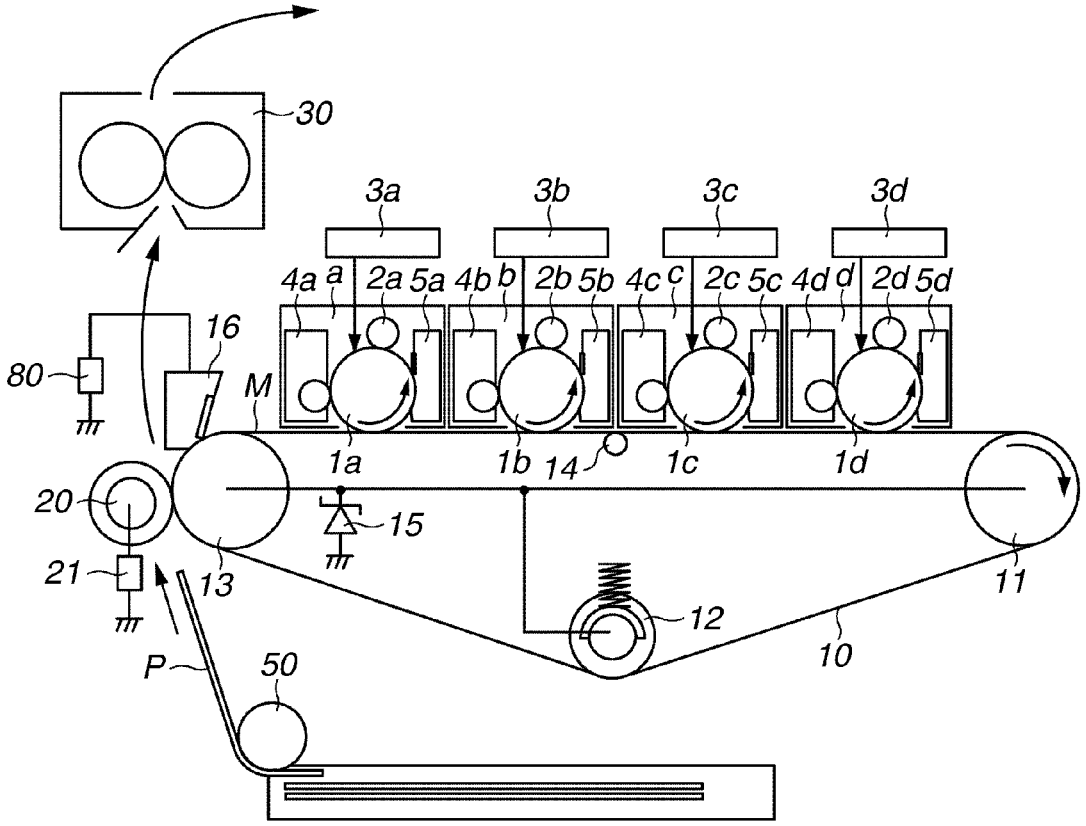
FIG. 28 illustrates a modified image forming apparatus according to the fourth exemplary embodiment.

The image forming apparatus illustrated in FIG. 27 is similar to the apparatus illustrated in FIG. 21 in that the Zener diode 15 (i.e., the voltage maintenance element) is connected to two stretch members (i.e., the secondary transfer counter roller 13 and the driving roller 11) that cooperatively form the primary transfer surface and is different from the apparatus illustrated in FIG. 21 in that the metallic roller 14 (i.e., the contact member) is not provided. The configuration illustrated in FIG. 27 is useful to increase the current flowing into each primary transfer portion because the current can be additionally supplied from the member other than the secondary transfer roller 20, in a state where the secondary transfer counter roller 13 and the driving roller 11 (i.e., the members cooperatively forming the primary transfer surface) are maintained at a predetermined potential or more. The configuration illustrated in FIG. 27 can increase the current flowing into each primary transfer portion without increasing the current supplied from the secondary transfer roller 20. Further, as illustrated in FIG. 28, the charging members 18 and 17 can be replaced by the cleaning unit 16 with a cleaning blade connected to an auxiliary power source 80. The image forming apparatus illustrated in FIG. 28 is similar to the image forming apparatus illustrated in FIG. 27 in obtainable effects.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. An image forming apparatus comprising:

an image carrier configured to carry toner images;

an electrically conductive intermediate transfer belt movable in an endless manner to which toner images are primary transferred from the image carrier;

first and second stretch members configured to stretch the intermediate transfer belt;

a secondary transfer member that contacts with the intermediate transfer belt, configured to secondary transfer the toner images from the intermediate transfer belt to recording materials;

a contact member that contacts with the intermediate transfer belt; and a voltage maintenance element that is connected to the contact member, wherein the image carrier contacts with the intermediate transfer belt in between the first stretch member and the second stretch member with respect to a moving direction of the intermediate transfer belt, the contact member is disposed on the intermediate transfer belt side to which the image carrier is disposed and contacts with the intermediate transfer belt in between the first stretch member and the second stretch member with respect to a moving direction of the intermediate transfer belt, and a potential of the contact member is kept to be equal to or higher than a predetermined potential according to a current that flows from the secondary transfer member to the intermediate transfer belt.

2. The image forming apparatus according to claim 1, wherein the contact member contacts with an inner circumferential surface of the intermediate transfer belt.

3. The image forming apparatus according to claim 1, wherein the first stretch member is connected to the voltage maintenance element, and a potential of the first stretch member is kept to be equal to or higher than the predetermined potential according to a current that flows from the secondary transfer member to the intermediate transfer belt.

4. The image forming apparatus according to claim 1, wherein the secondary transfer member contacts with an outer circumferential surface of the intermediate transfer belt.

5. The image forming apparatus according to claim 4, further comprising:

a transfer power source configured to apply a voltage to the secondary transfer member, wherein the intermediate transfer belt is supplied with a current from the transfer power source via the secondary transfer member.

6. The image forming apparatus according to claim 5, wherein the first stretch member is opposed to the secondary transfer member via the intermediate transfer belt.

7. The image forming apparatus according to claim 6, further comprising:

a charging member disposed at a position opposing to the first stretch member via the intermediate transfer belt, configured to charge a toner attached to the intermediate transfer belt; and a charging power source configured to apply a voltage to the charging member, wherein, in a case where a toner image is secondary transferred on a recording material from the intermediate transfer belt at a secondary transfer portion by also primary transferring a toner image from the image carrier to the intermediate transfer belt, a potential of the first stretch member to which the voltage maintenance element is connected and a potential of the contact member are kept to be equal to or higher than the predetermined potential according to a summed current that is obtained by adding a current supplied from the secondary transfer member via the intermediate transfer belt and a current supplied from the charging member via the intermediate transfer belt.

8. The image forming apparatus according to claim 7, further comprising:

a control unit configured to control the transfer power source and the charging power source, wherein the control unit controls a current supplied from the secondary transfer member to the intermediate transfer belt so as to be a fixed current amount, and the control unit controls a current supplied from the charging member to the intermediate transfer belt so as to vary according to a timing of an image forming process.

9. The image forming apparatus according to claim 8, wherein the control unit performs a control so that a current amount supplied from the charging power source to the intermediate transfer belt to be larger than a current amount supplied from the secondary transfer member to the intermediate transfer belt.

10. The image forming apparatus according to claim 1, wherein the image carrier is a plurality of image carriers each of which carries a toner image of different color.

11. The image forming apparatus according to claim 10, wherein a plurality of contact members are disposed in such a way as to correspond to the plurality of image carriers.

12. The image forming apparatus according to claim 11, wherein the plurality of contact members are a plurality of metallic rollers, and the plurality of metallic rollers are disposed at positions at a downstream side of a primary transfer portion, in a moving direction of the intermediate transfer belt, formed by the image carrier and the intermediate transfer belt which correspond with each other.

13. The image forming apparatus according to claim 10, further comprising:

an exposure unit configured to expose the plurality of image carriers respectively, wherein, in a case when the exposure unit forms an electrostatic latent image on the image carrier, the exposure unit also exposes a non-image portion of each of the image carriers where an image is not formed.

14. The image forming apparatus according to claim 10, wherein the contact member is supported in a manner raising the intermediate transfer belt up toward the image carrier side with respect to a horizontal plane formed by the plurality of image carriers and the intermediate transfer belt.

15. The image forming apparatus according to claim 1, wherein the voltage maintenance element is a constant-voltage element.

16. The image forming apparatus according to claim 1, wherein the voltage maintenance element is a plurality of Zener diodes, and a current supply member is capable of supplying positive or negative current to the intermediate transfer belt, and at least one of the Zener diodes is oppositely connected to another Zener diode.

17. An image forming apparatus comprising:

an image carrier configured to carry toner images;

an electrically conductive intermediate transfer belt movable in an endless manner to which toner images are primary transferred from the image carrier;

first and second stretch members configured to stretch the intermediate transfer belt;

a current supply member that contacts with the intermediate transfer belt, configured to supply a current to the intermediate transfer belt;

a contact member that contacts with the intermediate transfer belt; and a voltage maintenance element that is connected to the contact member and either one of the first stretch member or the second stretch member, wherein the image carrier contacts with the intermediate transfer belt in between the first stretch member and the second stretch member with respect to a moving direction of the intermediate transfer belt, the contact member is disposed on the intermediate transfer belt side to which the image carrier is disposed and contacts with the intermediate transfer belt in between the first stretch member and the second stretch member with respect to a moving direction of the intermediate transfer belt, and a potential of at least one of the first stretch member and the second stretch member which are connected with the voltage maintenance element, and the contact member are kept to be equal to or higher than a predetermined potential according to a current that flows from the current supply member to the intermediate transfer belt.

18. The image forming apparatus according to claim 17, wherein the image carrier is disposed, with respect to a moving direction of the intermediate transfer belt, on a downstream side of the first stretch member and an upstream side of the second stretch member.

19. The image forming apparatus according to claim 18, wherein the voltage maintenance element is connected to the first stretch member, and the contact member contacts with the intermediate transfer belt at a downstream side of the image carrier and the upstream side of the second stretch member with respect to a moving direction of the intermediate transfer belt.

20. The image forming apparatus according to claim 19, wherein the contact member contacts with an inner circumferential surface of the intermediate transfer belt.

21. The image forming apparatus according to claim 20, wherein the current supply member contacts with an outer peripheral surface of the intermediate transfer belt.

22. The image forming apparatus according to claim 21, further comprising:

a power source configured to apply a voltage to the current supply member, wherein the intermediate transfer belt is supplied with current from the power source via the current supply member.

23. The image forming apparatus according to claim 22, further comprising:

a charging member disposed at a position facing to the first stretch member via the intermediate transfer belt, configured to charge a toner attached to the intermediate transfer belt; and a charging power source configured to apply a voltage to the charging member, wherein, in a case where a toner image is secondary transferred on a recording material from the intermediate transfer belt at a secondary transfer portion by also primary transferring a toner image from the image carrier to the intermediate transfer belt, a potential of the first stretch member and a potential of the contact member are kept to be equal to or higher than the predetermined potential according to a summed current that is obtained by adding a current supplied from a secondary transfer member via the intermediate transfer belt and a current supplied from the charging member via the intermediate transfer belt.

24. The image forming apparatus according to claim 23, further comprising:

a control unit configured to control the power source and the charging power source, wherein the control unit controls a current supplied from the current supply member to the intermediate transfer belt so as to be a fixed current amount, and the control unit controls a current supplied from the charging member to the intermediate transfer belt so as to vary according to a timing of an image forming process.

25. The image forming apparatus according to claim 24, wherein the control unit performs a control so that a current amount supplied from the charging member to the intermediate transfer belt will be larger than a current amount supplied from the current supply member to the intermediate transfer belt.

26. The image forming apparatus according to claim 17, wherein the image carrier is a plurality of image carriers each of which carries a toner image of different color.

27. The image forming apparatus according to claim 26, wherein the contact member is a plurality of contact members each of which is disposed by corresponding to the plurality of image carriers respectively.

28. The image forming apparatus according to claim 27, wherein the plurality of contact members are a plurality of metallic rollers, and the plurality of metallic rollers are disposed at positions at a downstream side of a primary transfer portion, in a moving direction of the intermediate transfer belt, formed by the image carrier and the intermediate transfer belt which correspond with each other.

29. The image forming apparatus according to claim 26, further comprising:

an exposure unit configured to expose the plurality of image carriers respectively, wherein, in a case when the exposure unit forms an electrostatic latent image on the image carrier, the exposure unit also exposes a non-image portion of each of the image carriers where an image is not formed.

30. The image forming apparatus according to claim 17, wherein the voltage maintenance element is a constant-voltage element.

31. The image forming apparatus according to claim 17, wherein the voltage maintenance element is a plurality of Zener diodes, and the current supply member is capable of supplying positive or negative current to the intermediate transfer belt, and at least one of the Zener diodes is oppositely connected to another Zener diode.

32. An image forming apparatus comprising:

an image carrier configured to carry toner images;

an electrically conductive intermediate transfer belt movable in an endless manner to which toner images are primary transferred from the image carrier;

a secondary transfer member that contacts with the intermediate transfer belt, configured to secondary transfer the toner images from the intermediate transfer belt to recording materials at a secondary transfer portion;

an opposed member that is opposed to the secondary transfer portion via the intermediate transfer belt;

a contact member that contacts with an inner circumferential surface of the intermediate transfer belt and disposed at a position, with respect to a moving direction of the intermediate transfer belt, so that a distance between the contact member and the image carrier is shorter than a distance between the opposed member and the image carrier; and a constant-voltage element, wherein the opposed member and the contact member contact with each other via the constant-voltage element.

* * * * *